US006301758B1

(12) United States Patent
Biondo et al.

(10) Patent No.: US 6,301,758 B1
(45) Date of Patent: Oct. 16, 2001

(54) READY TO ASSEMBLE METAL CASKET

(75) Inventors: John P. Biondo, Aurora; Carl J. Holbert; Walter A. Hullemeyer, both of Batesville; Leonard D. Kincer, Sunman; Louis J. Scheele, Batesville, all of IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/356,550

(22) Filed: Jul. 19, 1999

(51) Int. Cl.[7] ..... A61G 17/00
(52) U.S. Cl. ..... 27/12; 27/19
(58) Field of Search ..... 27/2, 6, 7, 12, 27/19, 11; 5/611

(56) References Cited

U.S. PATENT DOCUMENTS

| | | | | |
|---|---|---|---|---|
| 1,027,453 | * | 5/1912 | Wible | 27/15 X |
| 2,664,615 | | 1/1954 | Hillenbrand et al. . | |
| 2,848,781 | * | 8/1958 | Slaughter, Jr. et al. | 27/12 |
| 2,867,030 | | 1/1959 | Hillenbrand . | |
| 2,947,059 | | 8/1960 | Hillenbrand . | |
| 2,964,824 | | 12/1960 | Hillenbrand . | |
| 3,041,704 | * | 7/1962 | Gruber | 27/12 |
| 4,137,613 | | 2/1979 | Ceresko . | |
| 4,524,472 | * | 6/1985 | Foust | 27/12 X |
| 4,571,791 | | 2/1986 | Ceresko . | |
| 4,621,395 | * | 11/1986 | Benoit | 27/12 |
| 4,930,197 | | 6/1990 | McClive . | |
| 4,951,367 | * | 8/1990 | Wolfe | 27/2 X |
| 4,961,896 | | 10/1990 | Constantino . | |
| 5,092,020 | * | 3/1992 | MaGuire | 27/2 X |
| 5,448,810 | | 9/1995 | Mackirdy . | |
| 5,495,648 | | 3/1996 | Rojdev et al. . | |
| 5,503,439 | | 4/1996 | LaJeunesse et al. . | |
| 5,570,493 | | 11/1996 | Gulick . | |
| 5,592,724 | | 1/1997 | Linville et al. . | |
| 5,615,464 | | 4/1997 | Rojdev . | |
| 5,634,247 | | 6/1997 | Bowling . | |
| 5,636,419 | | 6/1997 | Foye . | |
| 5,666,705 | * | 9/1997 | Semon | 27/19 |
| 5,675,877 | | 10/1997 | Lewis . | |
| 5,709,016 | | 1/1998 | Gulick et al. . | |
| 5,771,550 | * | 6/1998 | Laphan et al. | 27/2 X |
| 5,775,061 | | 7/1998 | Enneking et al. . | |
| 5,813,100 | | 9/1998 | Mackirdy . | |

* cited by examiner

*Primary Examiner*—Brian K. Green
(74) *Attorney, Agent, or Firm*—Wood, Herron & Evans, L.L.P.

(57) ABSTRACT

A metal casket that is readily assembled at a location remote from the location of manufacture. The casket has several different potential embodiments. For example, first and second tabs on respective first and second side walls are overlapped to form a joint connecting the first and second walls. In another embodiment, a plurality of side walls has peripheral slots extending from lower sections of respective walls. A bottom has a periphery extending into the peripheral slots of the side walls to join the bottom and the side walls together. In a further embodiment, a portion of a plurality of side walls have an upward opening groove for receiving a decorative material. In a still further embodiment a casket cover includes a cap providing an exterior finish of the casket and a dish disposed within the cap to provide an interior finish for the cover of the casket. The cover further has a frame with a first slot for receiving an edge of the cap and a second slot for receiving an edge of the dish. A header is connected to the cap and provides support for the dish and the frame to form an end of the cover.

15 Claims, 25 Drawing Sheets

READY TO ASSEMBLE METAL CASKET

FIELD OF THE INVENTION

This invention relates to caskets and more particularly, to a metal casket that can be shipped as a compact collection of casket parts and then easily assembled at a remote location.

BACKGROUND OF THE INVENTION

Caskets typically include a base or shell formed as a complete unit together with a lid or cover hinged to the base. The lid or cover is either a single cover extending the full length of the casket or separate lower and upper cover portions which are often capable of being individually opened and closed. Since the cover and shell are designed as a unit and coordinated with one another, typically the structure of the casket is completely or substantially completely manufactured at one facility and shipped as a fully assembled unit to its destination. A fully assembled casket occupies a large space and, as a result, shipping and storage costs are high.

Over recent years, there has been a continuing effort to provide a casket design that is comprised of a group or kit of components and subassemblies that may be very compactly packaged for shipping and therefore, more efficiently and economically transported through the distribution system to the destination of use of the casket. Preferably, the casket is easily assembled at a location remote from the factory, and the final product is as functional and visually appealing as if the casket had been fully assembled at the manufacturing facility. The success of such an operation depends to a great extent on the capability of the casket design to eliminate, from the assembly process, operations requiring great skill or complicated and expensive tooling.

Prefabricated or ready to assemble wooden caskets are known in the art as disclosed in U.S. Pat. Nos. 4,930,197 and 5,709,016. Prefabricated and ready to assemble metal caskets are also known in the art as disclosed in U.S. Pat. Nos. 5,448,810 and 5,813,100. As with wooden caskets, the manufacture and assembly of metal caskets is labor intensive and requires highly skilled labor using complex and expensive equipment. For example, metal casket parts are first fabricated and then welded together. The weld joints must be finished with a grinding operation, and thereafter, surfaces of the casket are finished typically by spray painting. While known prefabricated ready to assemble metal caskets function reasonably well, there is a continuing effort to provide simpler, less expensive and more easily assembled metal caskets that have comparable quality to those metal caskets assembled at a supplier's manufacturing facility.

SUMMARY OF THE INVENTION

The present invention provides a ready to assemble casket that is easily assembled at a location remote from where the components of the casket have been manufactured. The invention has the advantages of permitting a metal casket to be more economically packaged, shipped and stored prior to use. Further, the metal casket can be assembled with a minimum of simple tools and complicated welding and finishing operations are not required.

In accordance with the principles of the present invention and in accordance with one embodiment, the present invention provides a casket having a plurality of side walls including a first wall having a first tab extending from an edge of the first wall and a second wall having a second tab extending from an edge of the second wall. The first and second tabs are overlapped to form a joint connecting the first and second walls. A bottom is connected to lower portions of the side walls to form a shell therewith; and a cover is mounted on upper portions of the side walls to form a closure for the shell.

In another embodiment, the invention provides a casket having a plurality of side walls with peripheral slots extending from lower sections of respective walls. A bottom has a periphery extending into the peripheral slots of the side walls to join the bottom and the side walls together so that the bottom and side walls form a casket shell. A cover is mounted on upper portions of the side walls to form a closure for the shell.

In a further embodiment of the invention, a casket has a plurality of side walls wherein a portion of the side walls has an upward opening groove. A decorative material extends around the portion of the side walls and is secured in the groove. A bottom is connected to the side walls to form a shell; and a cover is mounted on upper portions of the side walls to form a closure for the shell.

In a still further embodiment of the invention, a casket includes a plurality of side walls and a bottom having a periphery connected with lower sections of the side walls to form a shell. A cover is mounted on upper portions of the side walls to form a closure for the shell, and the cover includes a cap providing an exterior finish for the cover of the casket and a dish disposed within the cap and providing an interior finish for the cover of the casket. The cover further has a frame with a first slot for receiving an edge of the cap and a second slot for receiving an edge of the dish. A header is connected to the cap and provides support for the dish and the frame to form an end of the cover. In another aspect of the invention, the cover is secured to the shell with a living hinge.

These and other objects and advantages of the present invention will become more readily apparent during the following detailed description taken in conjunction with the drawings herein.

DETAILED DESCRIPTION OF THE INVENTION

Figure 1:
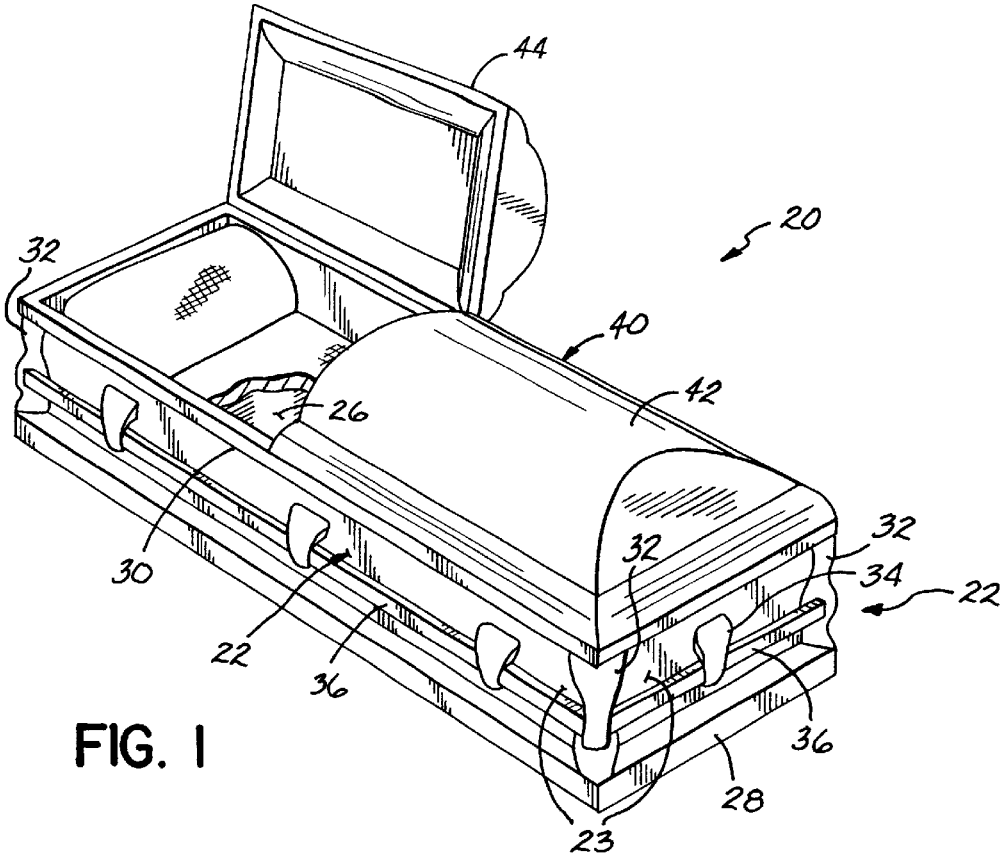
FIG. 1 is a perspective view of a casket assembly in accordance with the principles of the present invention.

Referring to FIG. 1, a presently preferred embodiment according to this invention of a casket 20 is shown. The casket 20 includes a generally rectangular shell 22 with four upstanding interconnected vertical walls 23 and a bottom 26. Each of the vertical walls 23 has a base element 28 and an upper rim element 30. Corner members 32 in association with brackets 34 support handles 36 that extend around the periphery of the casket 20.

The casket 20 also includes a cover 40 positioned on the upper edges of the shell 22. The cover 40 includes a lower or foot cover section 42 and an upper or head cover section 44. The upper section 44 is pivotally attached to an upper edge of the shell 12 independently of the lower section 42 so that the upper section 44 can be raised to the illustrated open position or lowered to a closed position (not shown). The sections 42, 44 of the cover 40 are pivotally attached to an upper edge of the shell 22 by hinges or other pivoting mechanisms (not shown) as is known in the art. The lower cover section 42 may or may not be pivotally mounted on the shell 22.

FIG. 1 is demonstrative of a finished casket as it would be received from the factory of the casket supplier. However, in accordance with the principles of the present invention, the casket of FIG. 1 is comprised of a group or kit of subassemblies and components that are shipped from the factory in an unassembled state. The casket is then assembled at a site remote from the factory preferably using only a few simple tools and not requiring any welding or surface finishing in the final assembly process. However, in some of the embodiments described herein, welding may be used as a joining process if so.

Casket Shell Constructions

Figure 2A:
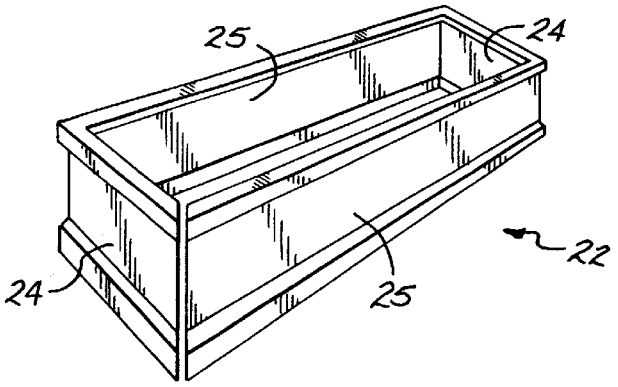
FIGS. 2A–2E are perspective views of alternative end and side wall structures that may be used to construct a casket shell.
Figure 2B:
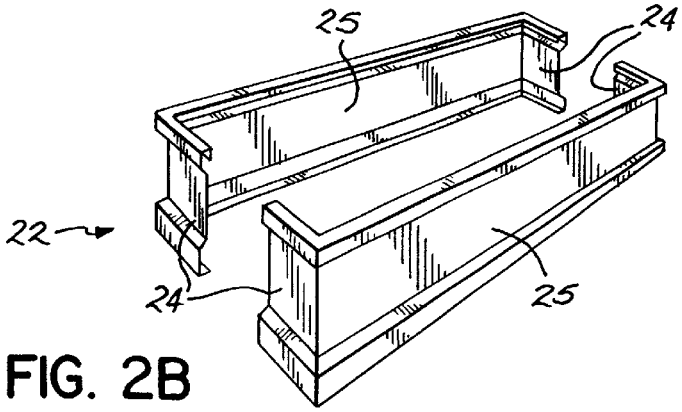
Figure 2C:
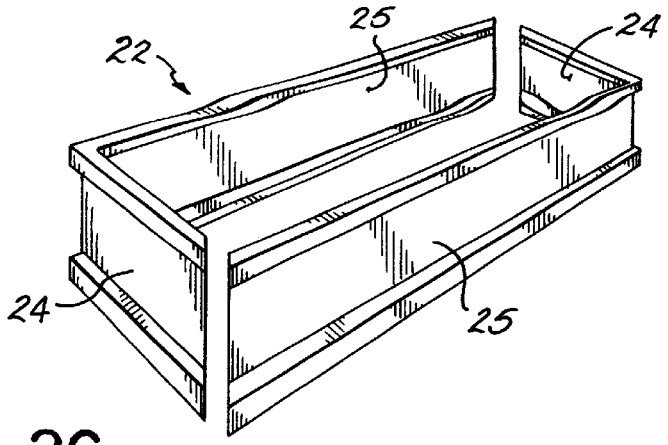
Figure 2D:
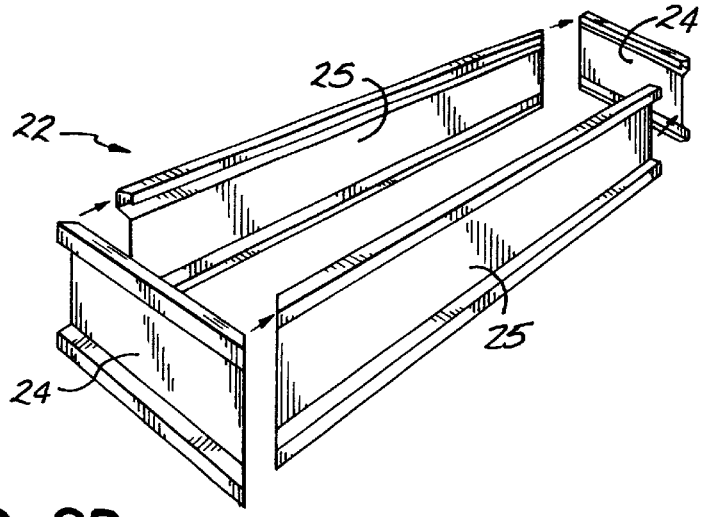
Figure 2E:
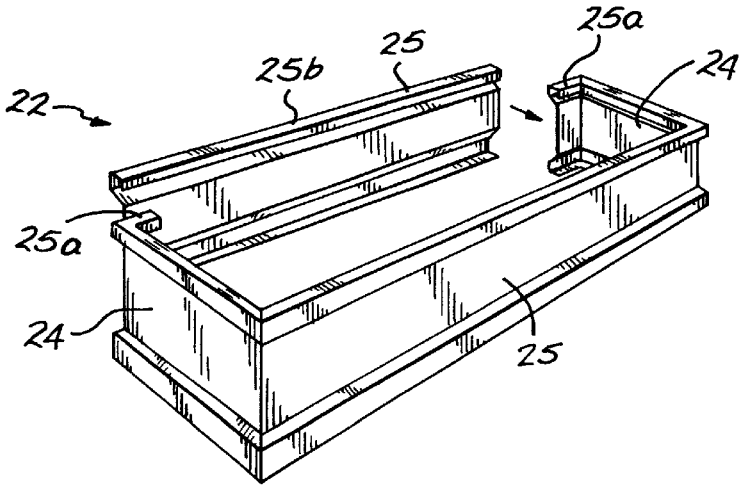

There are many potential unassembled configurations of the casket in which the casket shell 22 is designed in one or more separate pieces that are joined at one or more corners or at one or more locations intermediate the corners as illustrated in FIGS. 2A–2E. For example, referring to FIG. 2A, the shell 22 may be fabricated from a one or more pieces of formed sheet metal providing the desired vertical cross-sectional shape. The formed sheet metal has a length equal to the perimeter of the shell 22, and the sheet metal is then bent or folded to form the 90° corners such that the ends meet at one of the corners. Those ends are joined as will be further described. Another embodiment is illustrated in FIG. 2B in which the formed sheet metal of the shell is sheared to lengths equal to the sidewalls 25 and partial end walls 24. Those pieces are then bent or folded to the illustrated shape, and the end walls 24 are then joined as will be subsequently described. FIG. 2C illustrates a variation of the embodiment in FIG. 2A in which the shell is comprised of two pieces each having an end wall 24 and side wall 25. The two pieces are joined together at diagonal corners to form the complete shell 22. A further embodiment is illustrated in FIG. 2D in which separate end walls 24 and side walls 25 are formed and joined at their ends, thereby forming the corners of the shell 22. In FIG. 2E, a single shell component is formed to include the two end walls 24, a single full side wall 25 and partial side walls 25A. Another partial side wall section 25B is provided and is joined to the partial side wall portions 25A and 25B to form the complete shell 22. While five examples of combinations of partial or full end 24 and side walls 25 are illustrated in FIGS. 2A–2E, as will be appreciated, the shell 22 can be assembled from many other different combinations; and all of those combinations are within the spirit and scope of the present invention.

Figure 3:
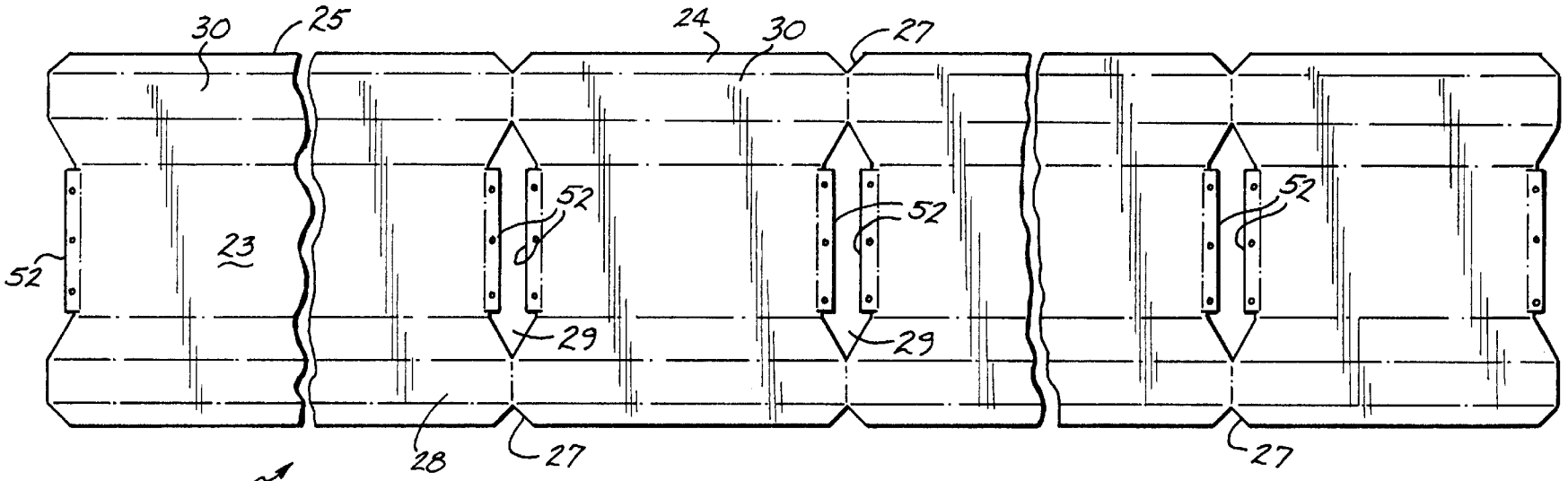
FIGS. 3 and 3A are plan view of one embodiment of a sheet metal stamping that may be used to fabricate a casket shell.
Figure 5:
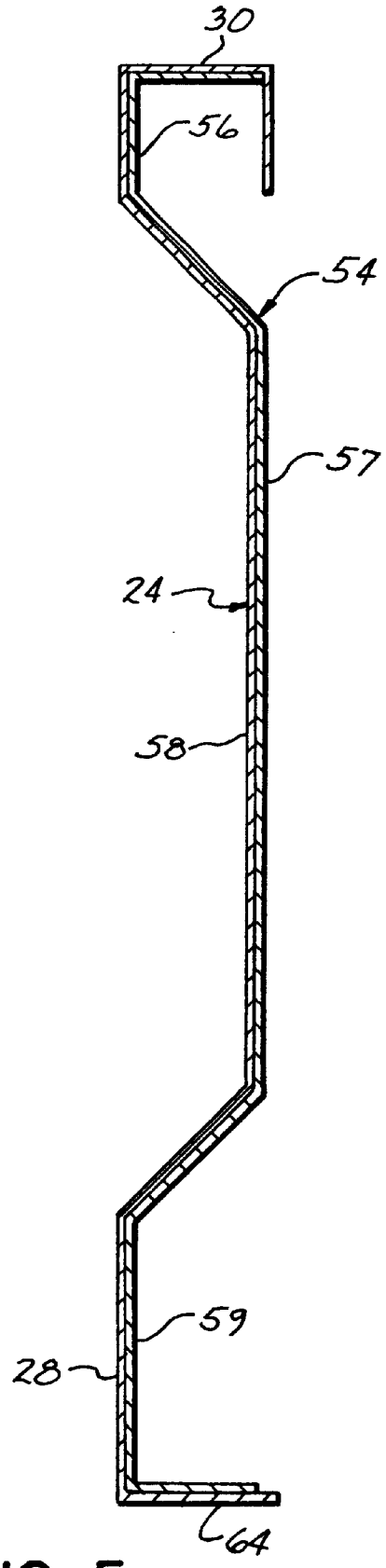
FIG. 5 is a cross-sectional view taken along line 5—5 of FIG. 4 and illustrates a cross-section of the assembled corner.

FIG. 3 illustrates one example of a piece of formed sheet metal that may be used to form the casket shells 22 illustrated in FIGS. 2A, 2C and 2D, that is, shell constructions which are joined at the corners. The sheet metal of the shell 22 can be manufactured from a single piece of prefinished metal, for example, a sheet metal coil of prefinished 20 gauge steel. The sheet metal coil is stamped, bent and/or roll formed in a continuous process to provide the desired cross-sectional profile of the walls 23 including respective base portions 28 and upper rim portions 30. One such a cross-section is shown in FIG. 5. The lengths of respective end and side wall sections 24, 25 are delineated by cutouts 27 and 29 that are located at the desired corners of the shell 22. Opposed connecting tabs 52 at the corners are also formed during the stamping process. The stamped and/or formed sheet metal is then sheared to lengths corresponding to the lengths of the desired combinations of full or partial side or end walls. Thus, when the sheared stamping is folded at 90° to form a corner, the tabs 52 are brought into an overlapping relationship. The free ends of the bent pieces are then joined together to provide the desired shell configuration, some examples of which are illustrated in FIG. 2.

If shell constructions are desired that required joining pieces intermediate the corners as shown in FIGS. 2B and 2E, the end or side walls 24, 25 may be formed or stamped as illustrated in phantom in FIG. 3. In this embodiment, a stamping process removes material from the base section 28 and the upper rim 30 in addition to forming the tabs 52. The stamping is then sheared to form two pieces each having a tab 52. The tabs 52 are then bent or folded toward the inside of the shell to 90°, and the shell sections are then brought together, thereby bringing the tabs 52 together as well as opposing ends of the base 28 and upper rim 30. The joint is then completed in a manner as will be subsequently described.

Figure 4:
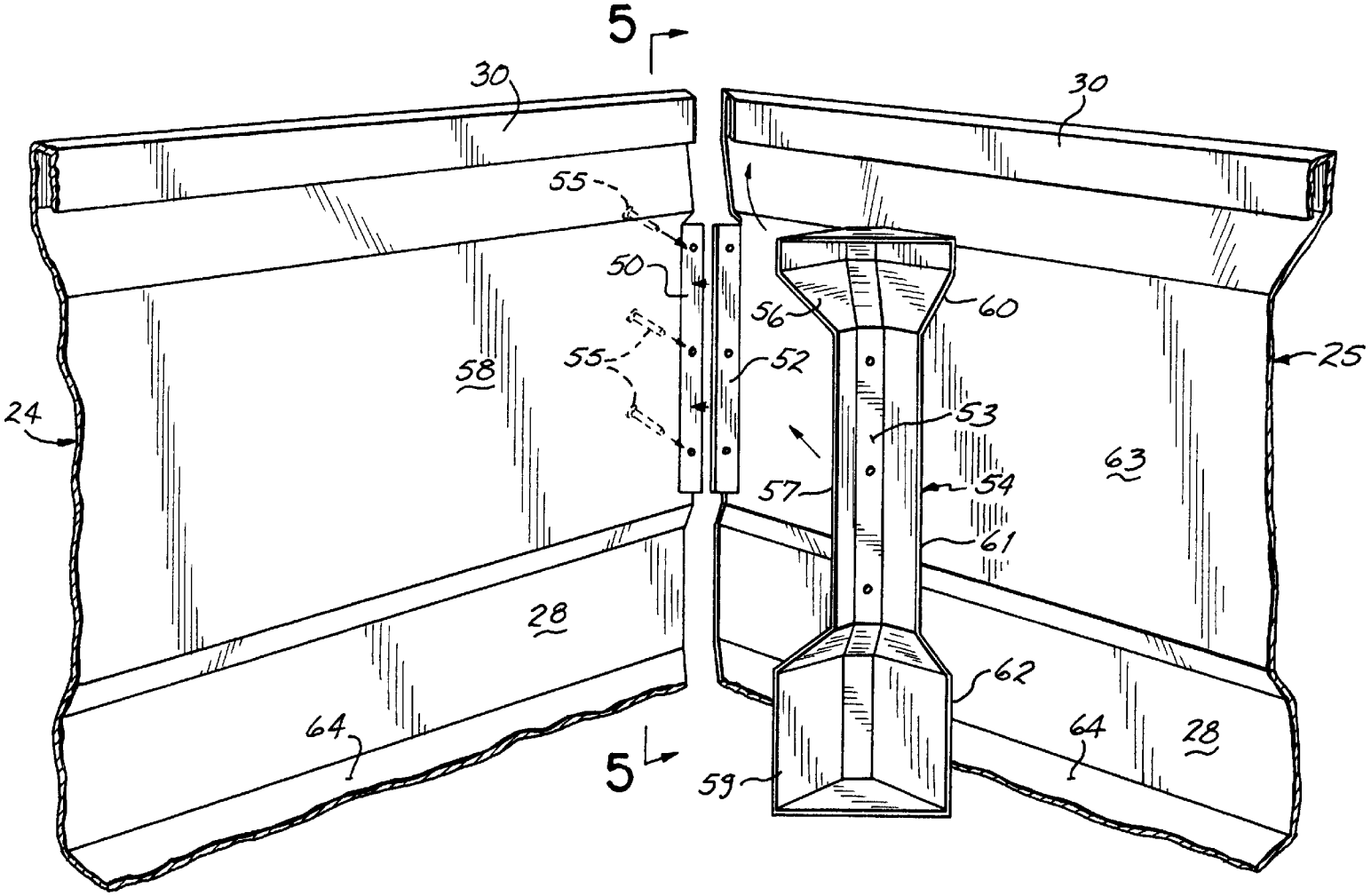
FIG. 4 is a perspective view of one embodiment of a disassembled interior corner of the casket assembly of FIG. 1.

After the end and shell side walls 24, 25 and their respective bases portions 28 and upper rims 30 have been roll formed and/or stamped and bent to form the corners as described with respect to FIGS. 2 and 3, the joints at the corners or intermediate the corners must be made. One design for joining the corners is illustrated in FIG. 4. To assemble the corner, the tabs 50, 52 are brought into an overlapping relationship which functions to bring together the ends of the walls 24, 25 including the base and rim elements 28, 30, respectively. An adhesive is applied to all areas of a backing corner plate 54 which contact surfaces of the end and side sections 24, 25. The corner plate 54 is then positioned in the internal corner formed by the intersection of the ends of the side sections 24, 25, thereby providing a support for and strengthening the corner. The three piece assembly 24, 25, 54 may be temporarily supported by a simple fixture (not shown) that is positioned to the outside of the end and side sections 24, 25 with supporting V-blocks (not shown) contacting the outside surfaces of the rim 30 and lower base 28 of the end and side sections 24, 25. Those three components may also be temporarily held by a spring operated clamp arm (not shown) extending from the supporting fixture. The assembly is then secured or tacked together by fasteners 55 that extend through the overlapping tabs 50, 52 and a rear wall 53 of the corner plate 54. Any suitable number of fasteners 55 may be used, and the fasteners 55 may be screws, bolts, rivets or other known fastening devices. Thus, the fasteners 55 maintain the integrity of the corner structure until the applied adhesive has cured. The adhesive has a further function of providing a seal at the intersection of the ends of the end and side sections 24, 25 to prevent fluids from escaping.

When the corner is properly assembled as shown in FIG. 5, outer surfaces of an upper rim portion 56 of the backing corner are disposed immediately adjacent inner surfaces of an upper rim portion 30 of the end wall 24. Similarly an outer surface of a central wall portion 57 of the backing corner plate 54 is disposed immediately adjacent an inner surface of a side wall portion 58 of the end wall 24, and outer surfaces of a base portion 59 of the backing corner plate 54 are disposed immediately adjacent inner surfaces of a base portion 28 of the end side 24. In a similar manner, the backing corner plate 54 has an upper rim portion 60, central wall 61 and base portion 62 that are disposed adjacent respective an upper rim portion 30, a central wall 63 and a base portion 28 of the side wall 25. As will be appreciated, instead of each of the end and side sections 24, 25 having singular long tabs 50, 52, respectively, the tabs 50, 52 may be replaced by a plurality of tabs located in the same general area and designed to overlap and receive a fastener 55.

Figure 6:
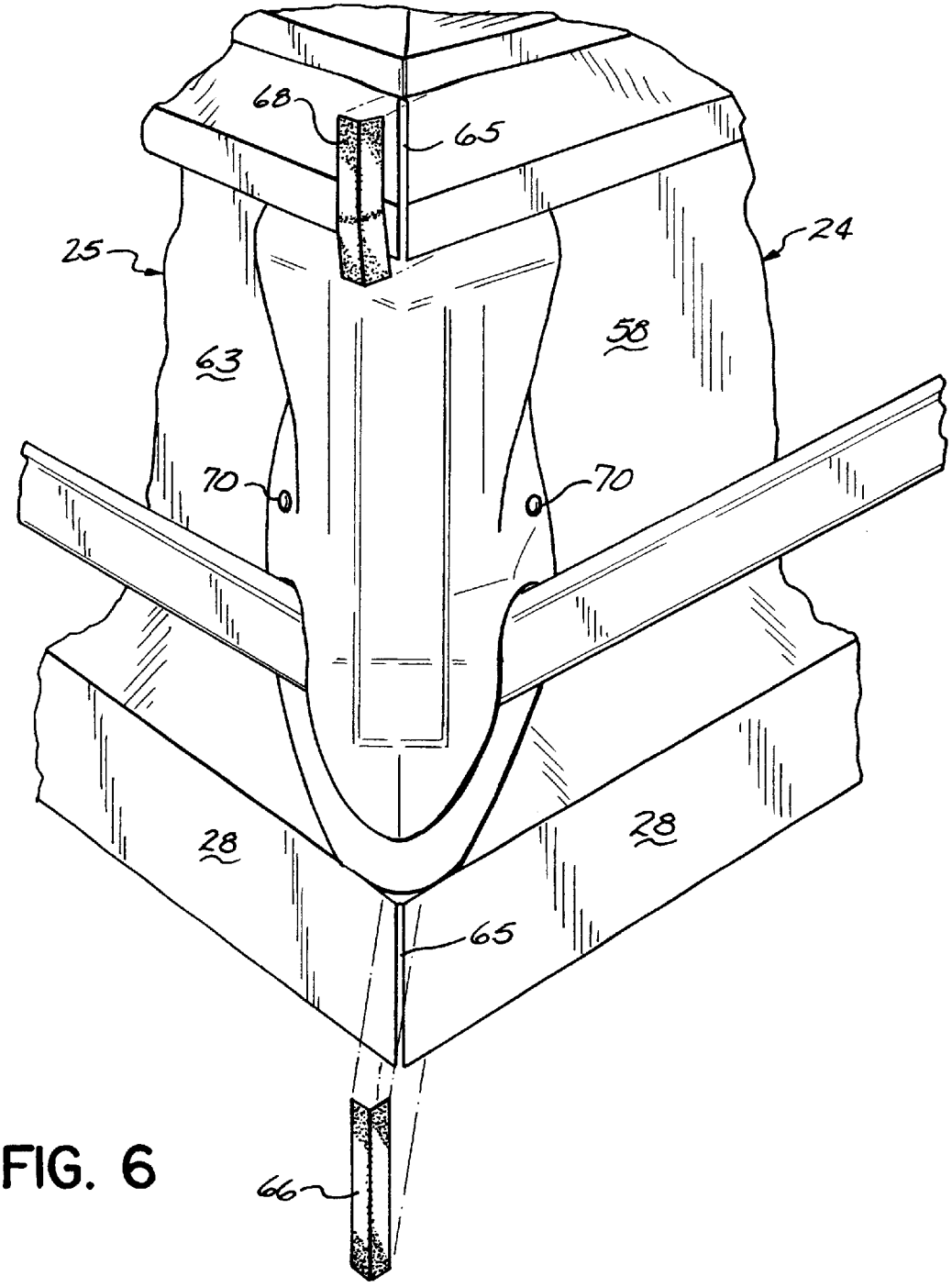
FIG. 6 is a perspective view of an exterior corner of the casket assembly of FIG. 1.

FIG. 6 illustrates an exterior of the fabricated corner described with respect to FIG. 4. While the central wall portions 58, 63 are brought together with the tabs 52, the base sections 28 and upper rim portions 30 will not join perfectly together. In fact, normally, there will be a gap 65 at the junction of the base sections 28 and upper rim portions 30 which is unsightly and unacceptable in a finished casket product. Therefore, to cover the gaps 65, the intersections of the lower base sections 28 of the respective end and side wall sections 24, 25 are covered by a lower external trim piece 66 which is adhered or glued in place. Similarly, an upper external trim piece 68 is similarly applied to the exterior of each of the intersections of the upper rails 30 of the respective end and side wall sections 24, 25. A corner trim piece 32 is applied to the outside of the corner to cover the joined tabs 52 and is secured by fasteners 70, adhesive or other means. The trim pieces 32, 66, 68 provide an acceptable finished appearance to the exteriors of the corner intersections of the walls 23. The trim pieces 32, 66, 68 may be molded, for example, injection molded, from plastic or other suitable material.

Figure 7:
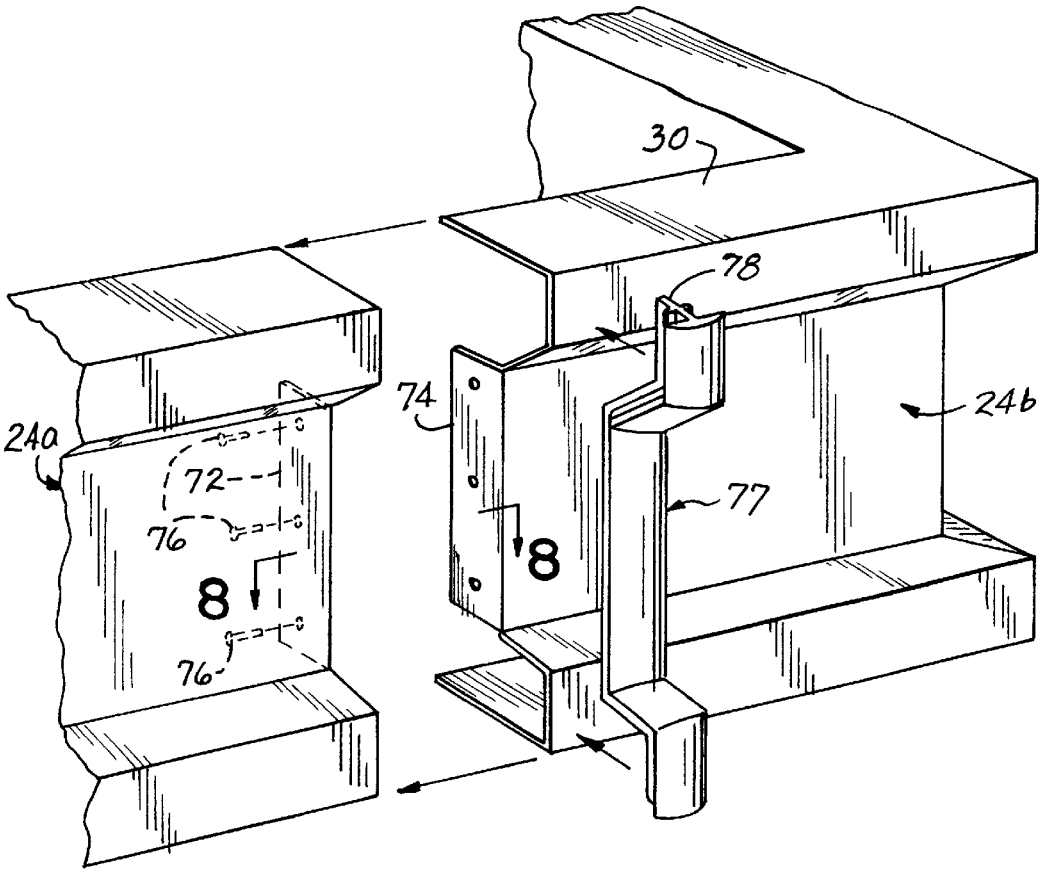
FIG. 7 is a perspective view of an embodiment of a disassembled joint in a side wall of the casket assembly illustrated in FIG. 1.
Figure 8:
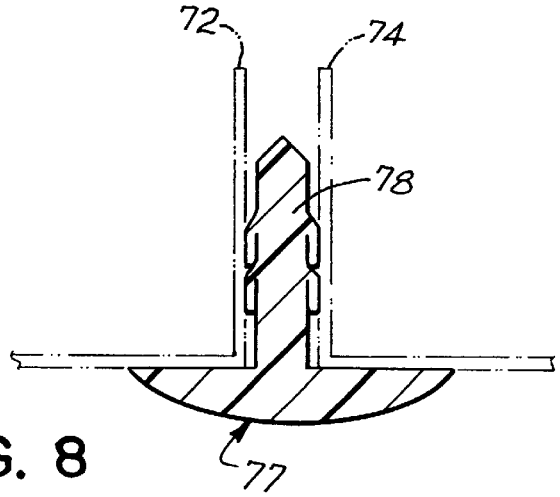
FIG. 8 is a cross-sectional view taken along line 8—8 of FIG. 7.

Referring to FIG. 7, in the embodiments illustrated in FIGS. 2B and 2E, it may be desirable to split an end wall 24 of the casket into separate sections 24*a*, 24*b*. The wall sections 24*a*, 24*b* are then joined together in the fabrication process as an alternative to, or in addition to, the joining one or more corners of the casket as described with respect to FIGS. 4–6. Referring to FIG. 7, end wall sections 24*a*, 24*b* have respective tabs 72, 74 that are directed toward the interior of the casket. Fasteners 76 extend through the tabs 72, 74 to connect the end wall sections 24*a*, 24*b* together. As previously described, an adhesive may be applied between the tabs 72, 74 to further secure the end wall sections 24*a*, 24*b* together. If the end wall sections 24*a*, 24*b* are fabricated very accurately, such as by a roll forming process, the resulting seam or joint between the end wall sections 24*a*, 24*b* may not be objectionable. However, alternatively, it may be desirable to utilize a trim piece 77 that covers the joint between the end wall sections 24*a*, 24*b* to improve the appearance. The trim piece 77 may be made from injection molded plastic or other material and attached to the end wall 24 by an adhesive. As shown in FIG. 8, the trim piece 77 may have a flange 78 that is wedged between the tabs 72, 74. A bracket 34 (FIG. 1) may also be used to obscure the joint between the end wall sections 24*a*, 24*b* either in place of, or in addition to, the trim piece 77 depending on the location of the tabs 72, 74 as well as the quality of the joint between the tabs 72, 74. For example, if the tabs 72, 74 are close to the centerline of the end wall 24, the bracket 34 may be sufficient to cover the joint between the tabs 72, 74. However, the appearance of the joint may dictate that both the bracket 34 and the trim piece 77 be used. In another embodiment, If the tabs 72, 74 are positioned at a location offset from the centerline of the end wall 24, then the bracket 34 would not cover the joint, and the trim piece 77 would normally be used.

While FIGS. 4–6 illustrate a preferred construction of a corner of the casket, the backing plate 54 may be modified in some respects to accommodate different constructions of the shell 22. The structure of the shell 22 must first adequately support the weight of the contents of the casket. In addition, it is preferable that the lower portion of the shell 22, for example, the lower 4 inches, provide a nonprotective seal, so that if a small amount of fluid accumulates in the bottom of the shell 22, the fluid will not leak from the casket.

Figure 9:
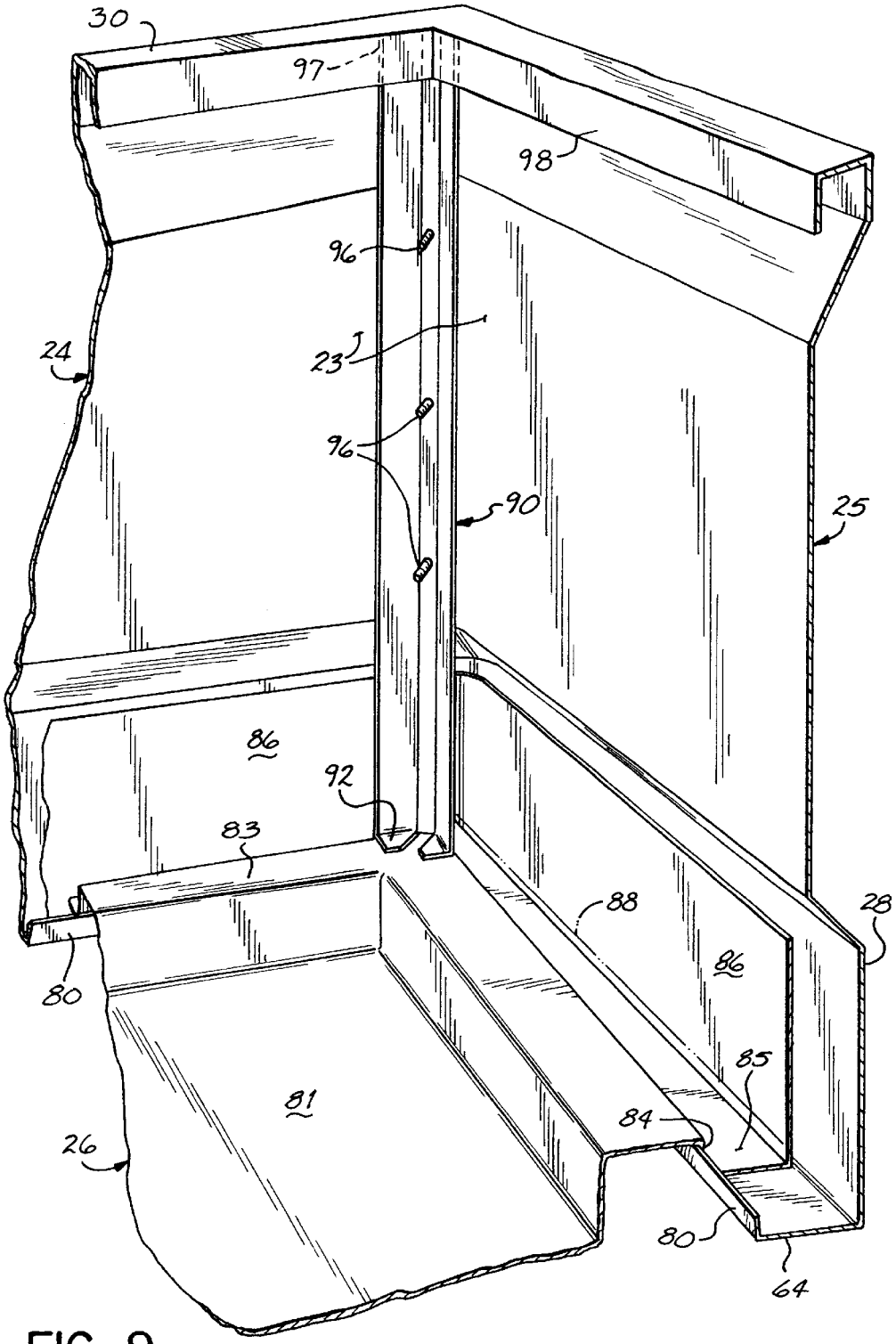
FIG. 9 is a perspective view of one embodiment of an interconnection of side walls with a bottom of the casket assembly illustrated in FIG. 1.

FIG. 9 illustrates a first embodiment for attaching the bottom 26 to the walls 23, for example, respective end and side wall sections 24 and 25. The walls 23 have a generally horizontal flange 64 that extends from the base element 28 and terminates with a generally vertical, upturned lip 80. Thus, the base element 28, flange 64 and lip 80 form a generally J-shaped channel or peripheral slot 79 extending from the lower edge of the walls 23 inward toward the interior of the casket 20. The bottom 26 is fabricated to form a pan area 81 with a peripheral raised wall section 82. The wall section 82 intersects at its upper edge a peripheral generally horizontal surface 83 that, in turn, intersects at its outer edge a downward directed, generally vertical peripheral wall section 84. The peripheral wall section 84 intersects at it lower edge a peripheral, generally horizontal surface 85 that, in turn, intersects at its outer edge an upper directed or, generally vertical, peripheral outer wall section 86. Thus, the wall section 84, surface 85 and peripheral wall 86 form a generally U-shaped upturned channel. The outer wall section 86 is higher, for example, 4 inches, and thus, being integral with the pan area 81 of the bottom section 26, is effective to contain small quantities of fluid in the casket 20. The entire bottom 26 from the pan section 81 to the peripheral side wall 86 may be drawn from a single piece of sheet metal. Alternatively, the entire bottom 26 from the pan section 81 to the peripheral surface 85 may be stamped from a single piece of sheet metal to include a short lip 88 (shown in phantom). The outer side wall 86 may then be fabricated and assembled with the bottom 26 by welding and/or adhering the wall section 86 to the lip 88.

In the assembly process, the bottom 26 is located in its desired position for assembly. The flange 64 of the walls 23 is located below the peripheral surface 85 of the bottom 26 such that the peripheral surface 85 of the U-shaped channel of the bottom 26 is located in the peripheral slots 79 of the walls 23. Adhesive may be applied between the flanges 64 and peripheral surface 85 and/or between the outer walls 86 and the walls 23 as desired. Thereafter, the corner formed by the intersection of the ends of the walls 23 is assembled by positioning the overlapping tabs as previously described and attaching corner backing plates 90 to the interior of the walls 23. The assembly of the walls 23, bottom 26 and corner plates 90 comprises the shell 22. Since the outer walls 86 of the bottom 26 function as a liquid seal, it is not required that the corner plates 90 perform that function; and therefore, the corner plates 90 have a different configuration than that illustrated in FIG. 2. The corner plates 90 provide structural support for the assembly of the corner at the intersection of the walls 23. In this second embodiment of a corner assembly, each corner plate 90 has a lower end formed into a foot 92 that is located on top of the peripheral surfaces 83 of the bottom 26. Therefore, upon securing the corner plate 90 with fasteners 96 and adhesive as previously described, the corner plate 90 also locks the bottom 26 with respect to the sidewalls 23 so that the surface 85 is secured within the channels 79 of the walls 23. Adhesive may be applied between the foot 92 and the surfaces 83. Since it is intended that the bottom 26 with the outer walls 86 provide a liquid seal, preferably fasteners are not used inside the perimeter of the outer walls 86. An upper end 98 of the corner plate 90 is disposed behind a downward projecting lip 98 within the upper rim portions 30 of the end and side walls, 24, 25, respectively.

Figure 10:
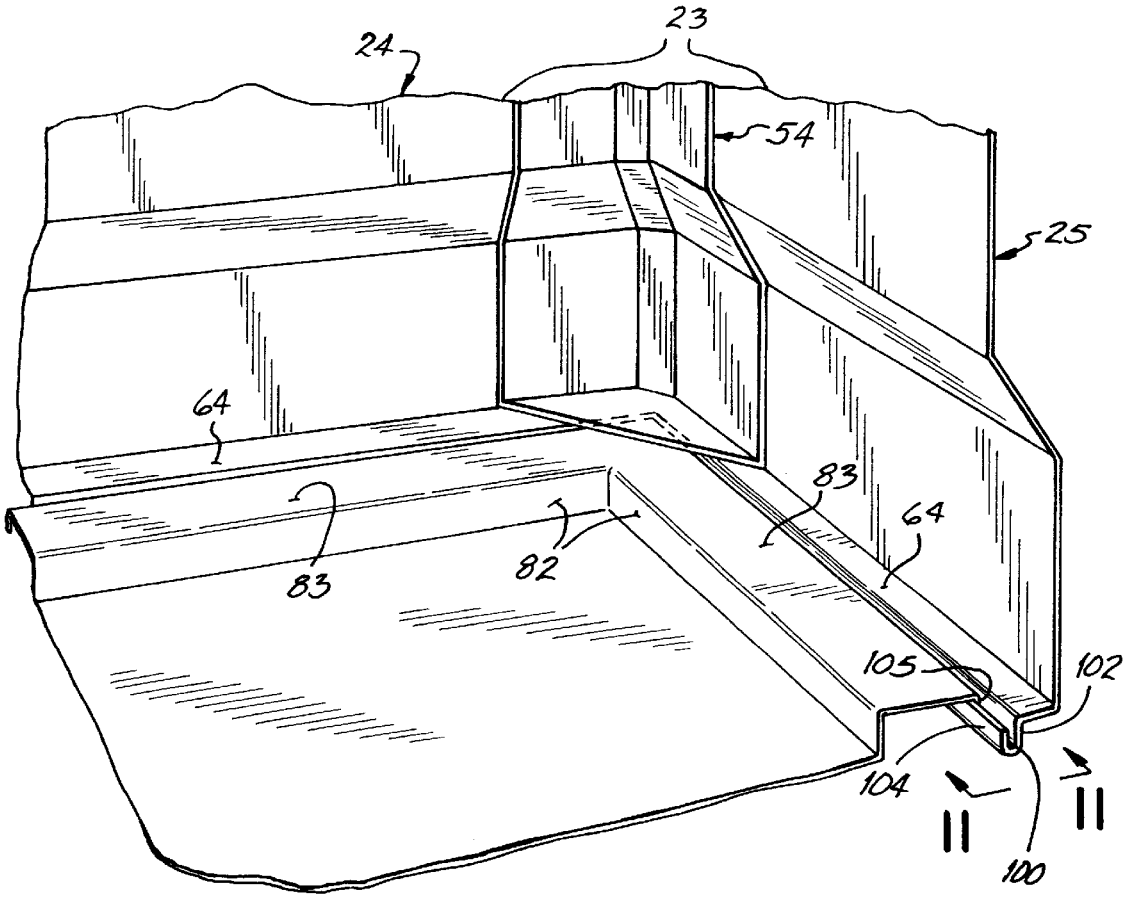
FIG. 10 is a perspective view of a second embodiment of an interconnection of side walls with a bottom of the casket assembly illustrated in FIG. 1.
Figure 11:
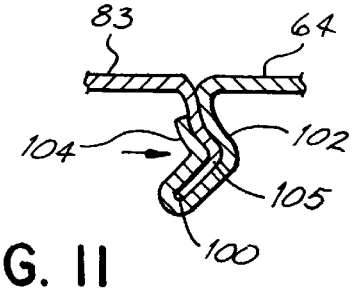
FIG. 11 is a cross-sectional view taken along the line 11—11 of FIG. 10.

FIGS. 10 and 11 illustrate an alternative construction of the bottom section 26 with the walls 23. In this embodiment, each of the flanges 64 that extend horizontally inward from the lower edge of a respective base element 28 of the walls 23 has a peripheral slot or peripheral groove 100 formed on its inner-directed peripheral edge. The slot or groove 100 has a space between its walls 102, 104 that is slightly larger than the thickness of the bottom section 26. The bottom 26 has an interior peripheral raised wall 82 that intersects at its upper edge a generally horizontal peripheral surface 83. The peripheral surface 83 intersects at its outer edge a downward directed wall 105 having a lower peripheral edge 106. In the assembly process, the peripheral edge 106 of the bottom section 26 is inserted into the peripheral groove 100 with an adhesive; and as shown in FIG. 11, the groove 100 is then crimped either at selected locations or, continually, over its length to mechanically secure the bottom 26 to the walls 23, thereby forming the shell 22. The groove 100 may also be rolled with a roll seaming machine. The walls 23 are also connected at their ends with a corner plate 54 in a manner as described with respect to FIGS. 4–6. Sufficient adhesive is used with the corner plate 54 and the groove 100 so that a minimal amount of fluid is retained within the shell 22 for some period, for example, several days.

Figure 12:
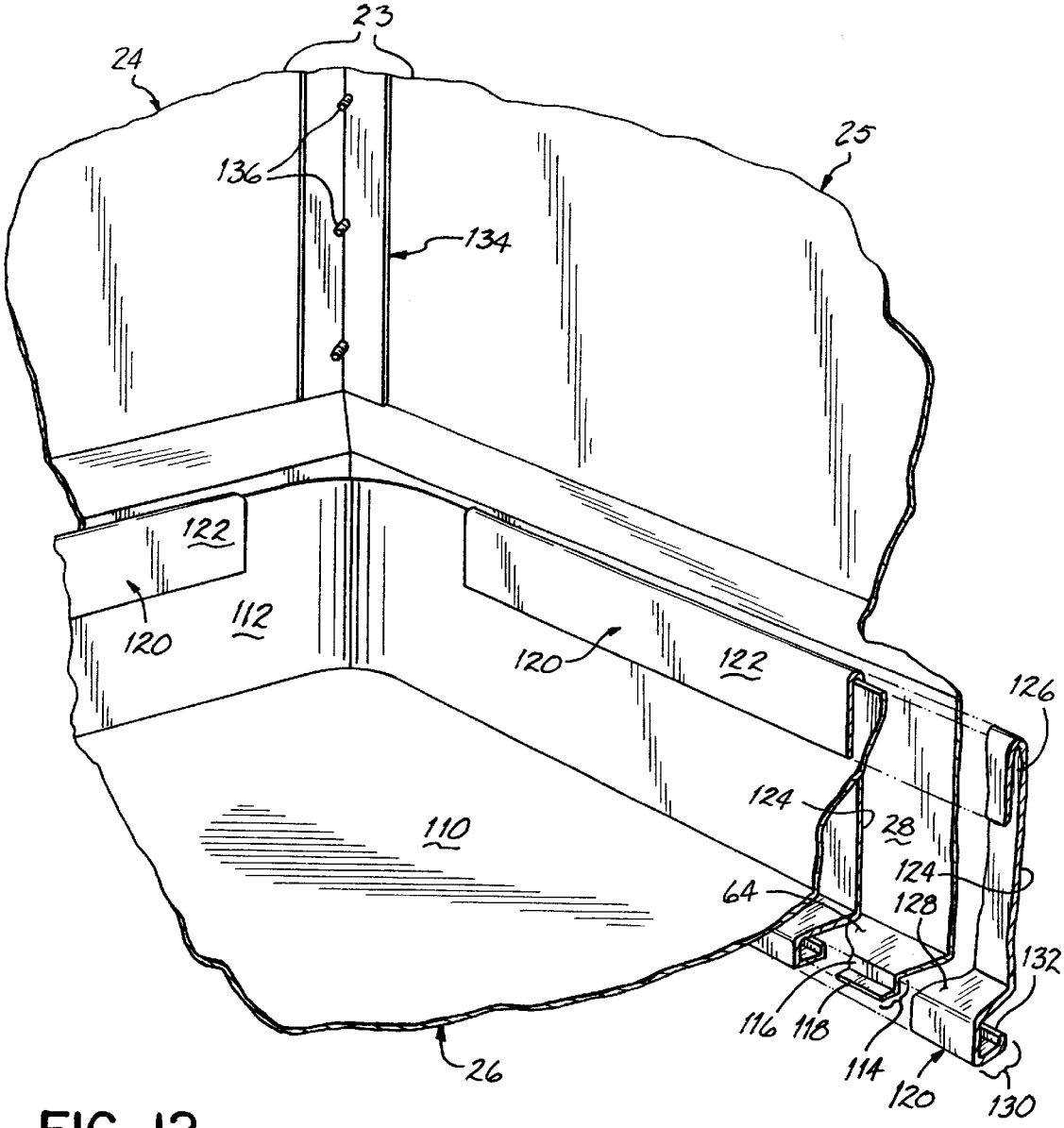
FIG. 12 is a perspective view of a third embodiment of an interconnection of side walls with a bottom of the casket assembly illustrated in FIG. 1.

FIG. 12 illustrates a third embodiment of the bottom 26 with the walls 23. The bottom 26 is normally made of metal and includes a pan area 110 having a generally vertical peripheral outer wall 112. The pan area 110 and outer wall 112 may be fabricated together using a metal drawing process or may be fabricated separately and joined to form a liquid type seal, thereby holding liquid within the volume of the bottom 26. The base element 28 of the walls 23 has a inner directed horizontal flange 64 extending from its lower edge. Extending from the inner directed edge of the flange 64 is an L-shaped element 114 having a generally vertical wall 116 intersecting the inner edge of the flange 64 and a second generally horizontal wall 118 extending inward toward the interior of the casket 20. The bottom 26 is connected to the walls 23 by means of metal clips 120. Each clip 120 extends substantially the full length of each of the walls 23.

The upper ends of the clips 120 have upper sides 122 that are folded over and substantially parallel to the main vertical walls 124 to form a groove or peripheral slot 126 that receives the upper edge of the outer walls 112 of the bottom 26. The clips 120 have an inner directed generally horizontal lower side 128 that extends from the bottom of the vertical side 124. At the inner edge of the lower side 128, the clips 120 terminate with a downward and outward directed, generally J-shaped element 130. The J-shaped element 130 terminates on its outer peripheral edge with an upper directed lip 132.

In the assembly process, the peripheral slots 126 of the clips 120 are located on the upper peripheral edges of the outer wall sections 112 of the bottom 26. Thereafter, the L-shaped portions 114 of the walls 23 are slid into the J-shaped elements 130 of the clips 120, thereby placing the flanges 64 in mechanical communication with one longitudinal side of the clips 120. Upon inserting the walls 23 into the clips 120, the horizontal sections 118 are located above the bottom portions 131 of the J-shaped elements 130. In addition, the lip sections 132 of the J-shaped elements 130 extend upward along the outer directed surfaces of the vertical sections 116. Thus, the clips 120 capture the lower portions of the walls 23 and prevent relative motion with the walls 23 either up, down or laterally. Further, the clips 120 also capture the bottom 26 in the vertical and lateral directions, and thus, the bottom 26 is restrained from vertical and lateral motion with respect to the walls 23. Thereafter, as described with respect to FIG. 4, tabs at the ends of the walls 23 are positioned in an overlapping relationship, and a simple right angle corner plate 134 is located against the central wall sections 58, 63 of the end and side walls 24, 25, respectively. The corner plate 134 is held in place by fasteners 136 and/or adhesive in a manner similar to that as previously described with respect to FIG. 9. As will be appreciated, the corner plate 134 may be abbreviated and not extend into the base 28 or upper rim 30, and further, the upper end of the corner plate 134 may extend into the upper rim portion 30 as further illustrated in FIG. 9. Alternatively, the corner plate 134 may be identical to the corner plate illustrated in FIG. 4.

Figure 13:
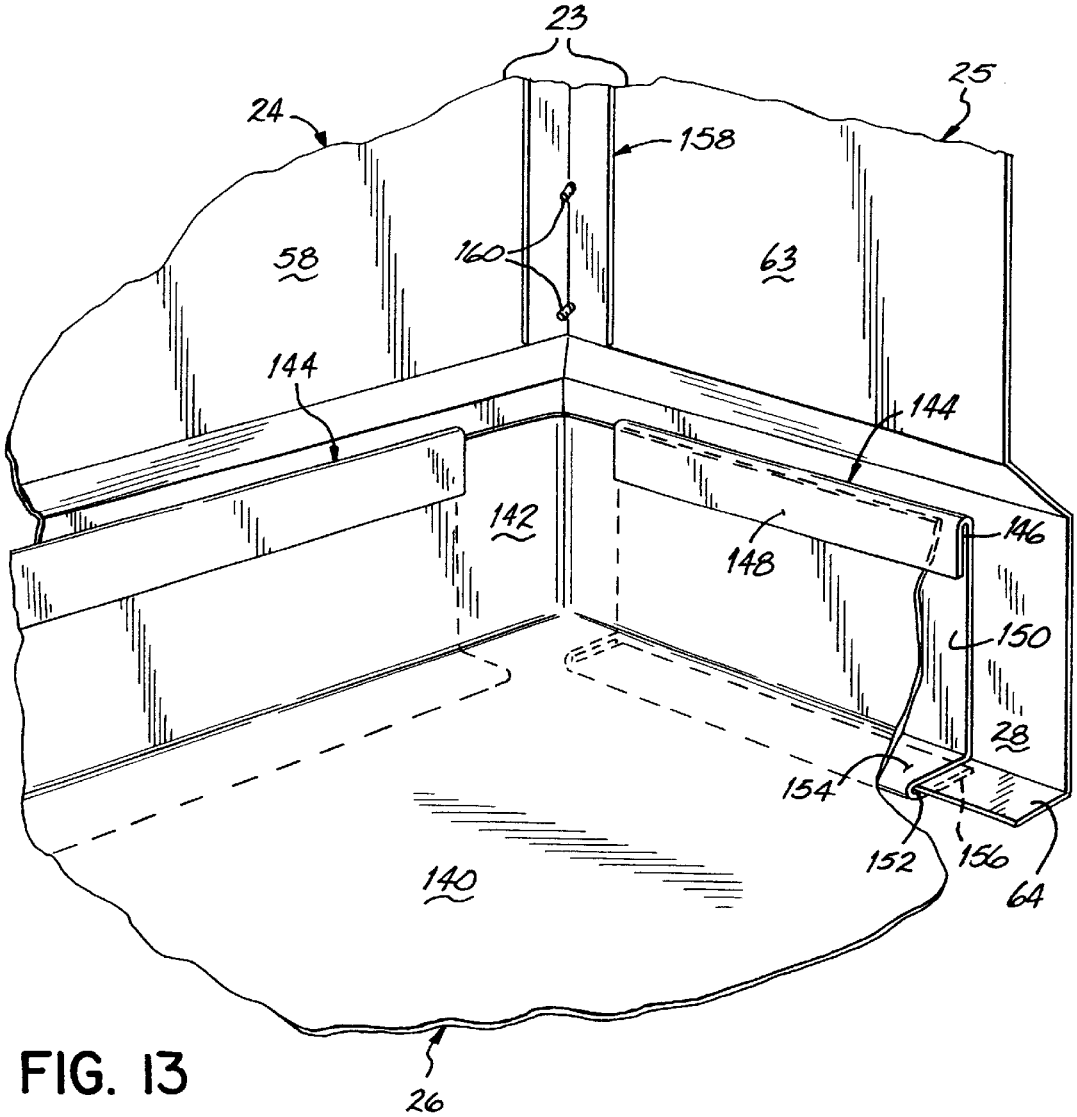
FIG. 13 is a perspective view of a fourth embodiment of an interconnection of side walls with a bottom of the casket assembly illustrated in FIG. 1.

FIG. 13 illustrates a further embodiment of a bottom 26 and walls 23. The bottom 26 is comprised of a plastic pan 140 having integral vertical side walls 142. The pan 140 is preferably produced by vacuum forming a plastic blank. The bottom 26 is interconnected with the walls 23 by means of clips 144. The clips 144 are fabricated along one side to form a longitudinal peripheral slot 146 between a forward side wall 148 and a main clip side wall 150. The opposite sides of the clips 144 have a second longitudinal slot or groove 152 formed between lower clip walls 154, 156.

In the assembly process, the longitudinal slots 146 of the clips 144 are first placed over the upper periphery of the vertical walls 142 of the bottom 26. Thereafter, flanges 64 that extend horizontally from the bottom of base elements 28 of the walls 23 are inserted into the longitudinal slots 152 formed between the lower walls 154, 156 of the clips 144. The tabs at the ends of the walls 23 are located in an overlapping relationship, and a corner plate 158 is located on the interior of the walls 23. Fasteners 160 and/or adhesive are used to rigidly connect the tabs at the ends of the walls 23 with the corner plate 158. The corner is assembled in a manner similar to that described in FIG. 12; and further, the corner plate 158 may have different embodiments as described with respect to the corner plate 134 of FIG. 12. After all of the corners between the separable walls 23 have been joined, the bottom 26 is secured vertically and horizontally within the interior of the walls 23 by the clips 144 and the corner structures at the intersections of the walls 23. Again, the pan 140 with its walls 142 is effective to retain small amounts of fluid within the casket 20. That capability is achieved with this embodiment without the requirement of utilizing adhesives or glues in the basic construction of the shell 22.

Figure 14:
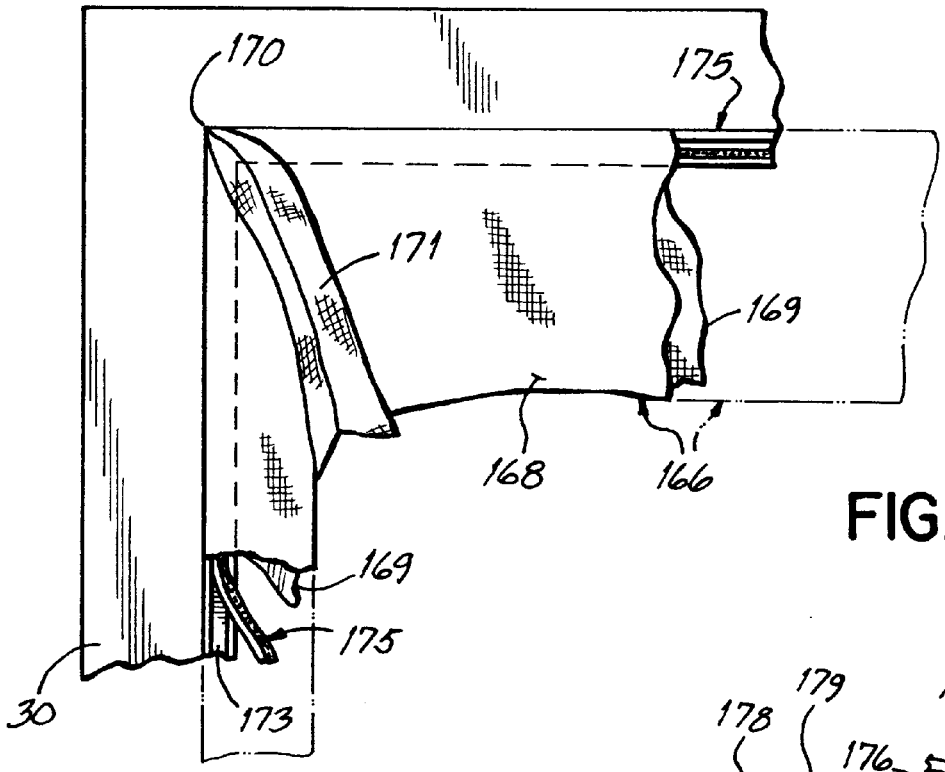
FIG. 14 is a partial perspective view of a corner of a shell illustrating casket material folded toward the inside of the casket and one embodiment for securing material to the finished shell in accordance with the principles of the present invention.
Figure 15:
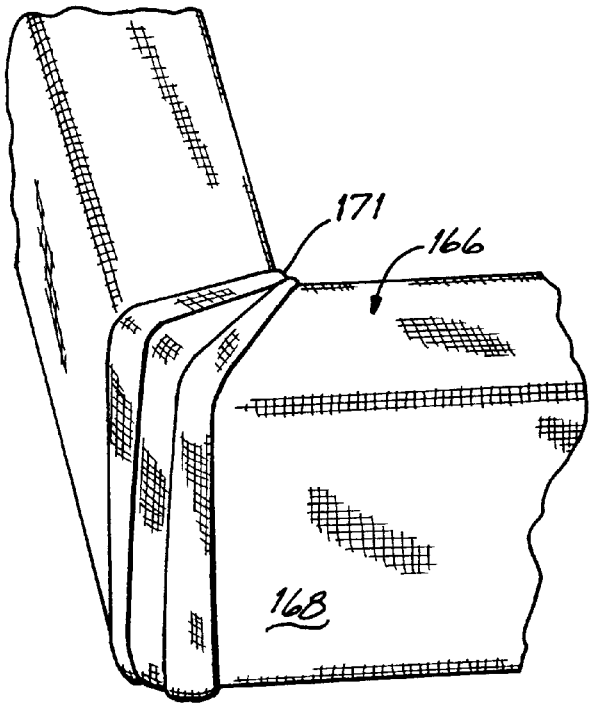
FIG. 15 is a partial perspective view of the corner of the shell of FIG. 14 illustrating casket material folded toward the outside of the casket.

After the shell has been assembled in accordance with one of the structural embodiments described above, a decorative material such as a fabric is installed. Referring to FIG. 14, the decorative fabric material 166 is normally supplied as a single piece having a length sufficient to extend around the head end and front side walls of the casket that are beneath the upper cover 44 (FIG. 1). The material 166 has a first, "big body" portion 168 that, when the casket is closed for burial, is draped over the interior of the head end and front side walls of the casket shell 22. Normally, in laying the material around a corner 170 of the casket 22, the material 166 would be cut and sewn together to custom fit the material 166 around the corner 170. In this embodiment, the excess of the material 166 that results from forming the material 166 around the corner 170 is neatly folded into a decorative pattern or "diaper fold" 171, thereby eliminating the cutting and sewing process while still providing an acceptable corner treatment. The fabric 166 further has a skirt portion 169 that extends downward approximately 13 inches over the interior walls of the casket. When the casket is opened for viewing purposes, as shown in FIG. 15, the "big body" portion 168 is folded over the top and exterior of the head end and front side walls of the casket 20. As before, the excess of the material 166 that results from forming the material 166 around the corner 170 is neatly folded into a decorative pattern or "diaper fold" 171. The "big body" portion 168 and skirt portion 169 are separated by the securing means for the material 166.

Figure 16:
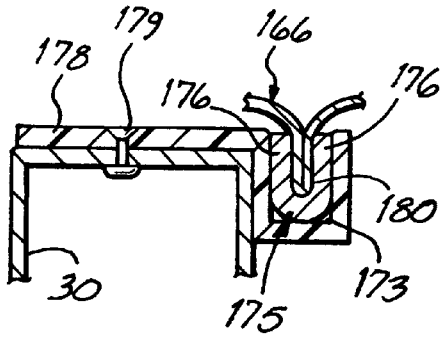
FIG. 16 is a cross-sectional view taken along line 16—16 of FIG. 14 and illustrates a second embodiment of an extrusion for securing material to a casket shell.

The material 166 is secured in place by utilizing an upward opening groove 173 that is formed along the inner periphery of all or a part of the upper rim 30 of the walls 23. The groove element 173 can be roll formed into the upper rim portion 30 of the end and side walls 24, 25 or attached as a separate element to the end and side walls 24, 25. Referring to FIG. 16, the groove 173 may be formed on the edge of a flat shell rim frame 178 that is mounted on top of the upper rim 30 of the walls 23 of the casket shell 22 by an adhesive, fasteners 179 or other suitable means. In this embodiment, the fabric 166 is first inserted into the slot 180 between the legs 176 of the wedge 175. Thereafter, the legs 176 are squeezed together and the wedge 175 is inserted into the groove 173, thereby securing the fabric 166 in place. As will be appreciated, in other embodiments, the fabric 166 may be connected to the wedge 175 by sonic welding adhesive or another process such that only the wedge 175 need be inserted into the groove 173. Such an arrangement may simplify the application of the material 166 to the shell 22.

Figures 17, 18:
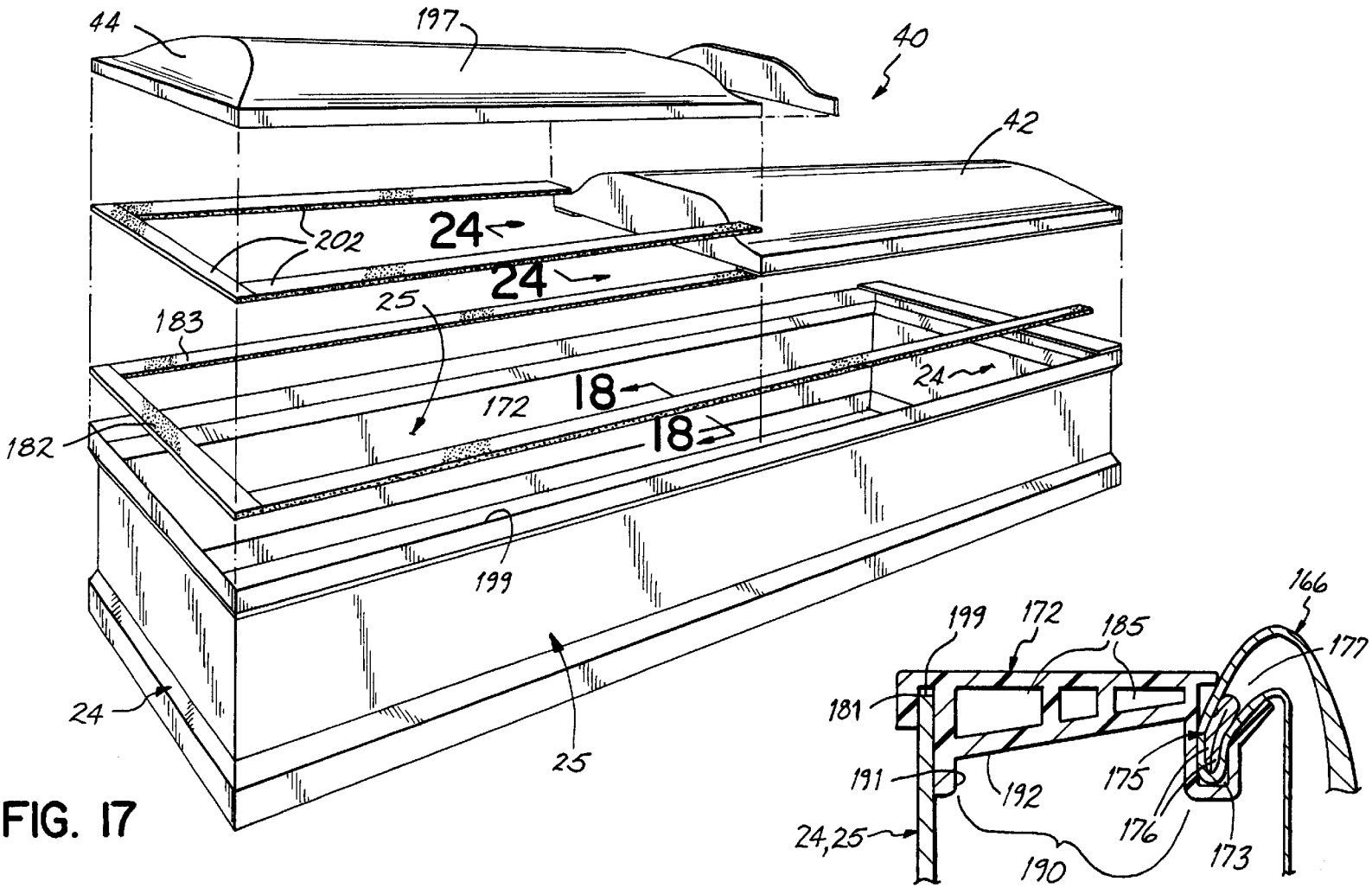
FIG. 17 is a perspective view of the casket shell and cover with the shell extrusions and cover components being shown disassembled.
FIG. 18 is a cross-sectional view taken along line 18—18 of FIG. 17 and illustrates a first embodiment of an extrusion for securing material to a casket shell.

An alternative embodiment of the upper portion of the shell is illustrated in FIG. 17. In this embodiment, the upper rim portion 30 of the shell 22 is removed; and the end and side walls 24, 25 terminate with an upper directed edge 199. Further, as shown in FIG. 18, an upper shell rim frame 172 has a slot 181 that receives the edge 199 of the respective end and side walls 24, 25 around the perimeter of the shell 22. The shell rim frame 172 can be extruded from an ABS material or other suitable plastic or metal material and secured to the top of the casket walls 23 by an adhesive or other suitable means. The groove 173 may be formed as part of the shell rim frame 172, and the material 166 can be secured in the groove 173 by means of a wedge 175. The wedge 175 is preferably generally V-shaped plastic extrusion with sides or legs 176 that bend or flex with respect to each other. The material 166 is first inserted into the groove 173. Thereafter, the wedge 175 is squeezed together as it passes through the relatively narrow opening 177 of the slot of the groove 173. As the wedge 175 enters the groove 173, the legs 176 expand slightly, thereby capturing the material 166 securely within the groove 173.

Figure 19:
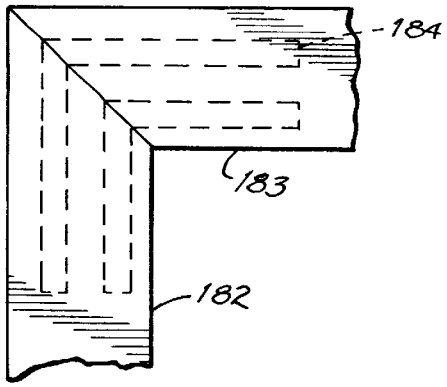
FIG. 19 is a top plan view of one embodiment for joining shell rim frame members to form a corner in accordance with the principles of the present invention.

The shell rim frame 172 is fabricated from a continuous extrusion in accordance with one of several different embodiments. For example, referring to FIG. 19, adjoining end and side rim frame members 182, 183, respectively, are cut or mitered at a 45° angle to form abutting ends. L-shaped links 184 are shaped to fit within the internal channels 185 (FIG. 18) of the shell rim frame 172. The links 184 are attached to the respective rim frame members 182, 183 by adhesive, fasteners, sonic welding or other means.

Figure 20:
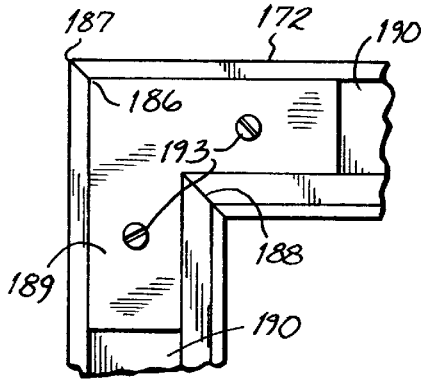
FIG. 20 is a bottom plan view of another embodiment for forming a corner in the shell rim frame.

Referring to FIG. 20, in another embodiment, a corner may be formed without cutting the shell rim frame 172 into two separate pieces. In a known manner, a 90° notch is cut into the shell rim frame 172 with the apex 186 of the notch being located at the location of the corner 187. The shell rim frame 172 is then folded to bring the sides 188 of the notch together, thereby forming a 90° corner in the shell rim frame 172. A single L-shaped key 189 is shaped to fit within a channel 190 (FIG. 18) formed between adjacent intersecting surfaces 191, 192 (FIG. 18). The L-shaped key 189 is normally connected to the intersecting members of the rim frame 172 by means of adhesive, welding or fasteners 193. Alternatively, the corner 187 may be formed by mitering intersecting ends of the shell rim frame 172 and securing them together in a manner as described above with respect to FIG. 19.

Figure 21:
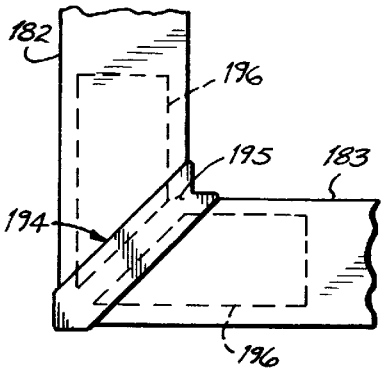
FIG. 21 is a top plan view of a further embodiment of a corner construction for the shell rim frame.

FIG. 21 illustrates a third alternative embodiment of forming a corner for the shell rim frame 172. As previously described, the shell rim frame 172 is cut or mitered at 45° to form end and side rim frame members 182, 183, and those rim frame members 182, 183 are inserted into a corner molding 194. The corner molding 194 has an exposed trim surface 195 that covers the intersection between the rim frame members 182, 183. The molding 194 further has integral molded keys 196 oriented at right angles and shaped to fit into the channel 190 (FIG. 18). As will be appreciated, the keys 196 can also be molded as one or more keys that have a shape that fits within the openings 185 of the shell rim frame 172 (FIG. 18).

Figure 22:
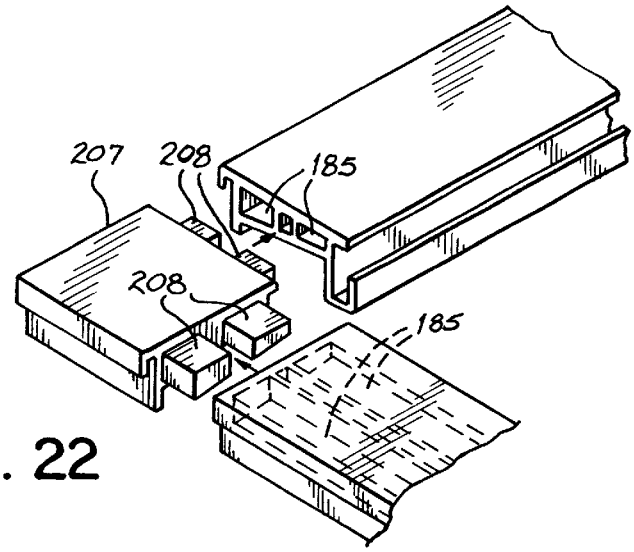
FIG. 22 is a disassembled partial perspective view of another embodiment for forming a corner in the shell rim frame.

FIG. 22 illustrates a further alternative embodiment of forming a corner for the shell rim frame 172. In this embodiment, a corner connector 207 is molded with tabs 208 that are shaped to be inserted into the cavities 185 (FIG. 18) of the shell frame members 172. Alternatively, the tabs 208 may be shaped to be inserted into the slot 190 of the shell frame members 172. The tabs 208 are connected to the shell frame members by welding, adhesives, mechanical fasteners or other appropriate fastening means.

Casket Cover Constructions

Figure 23:
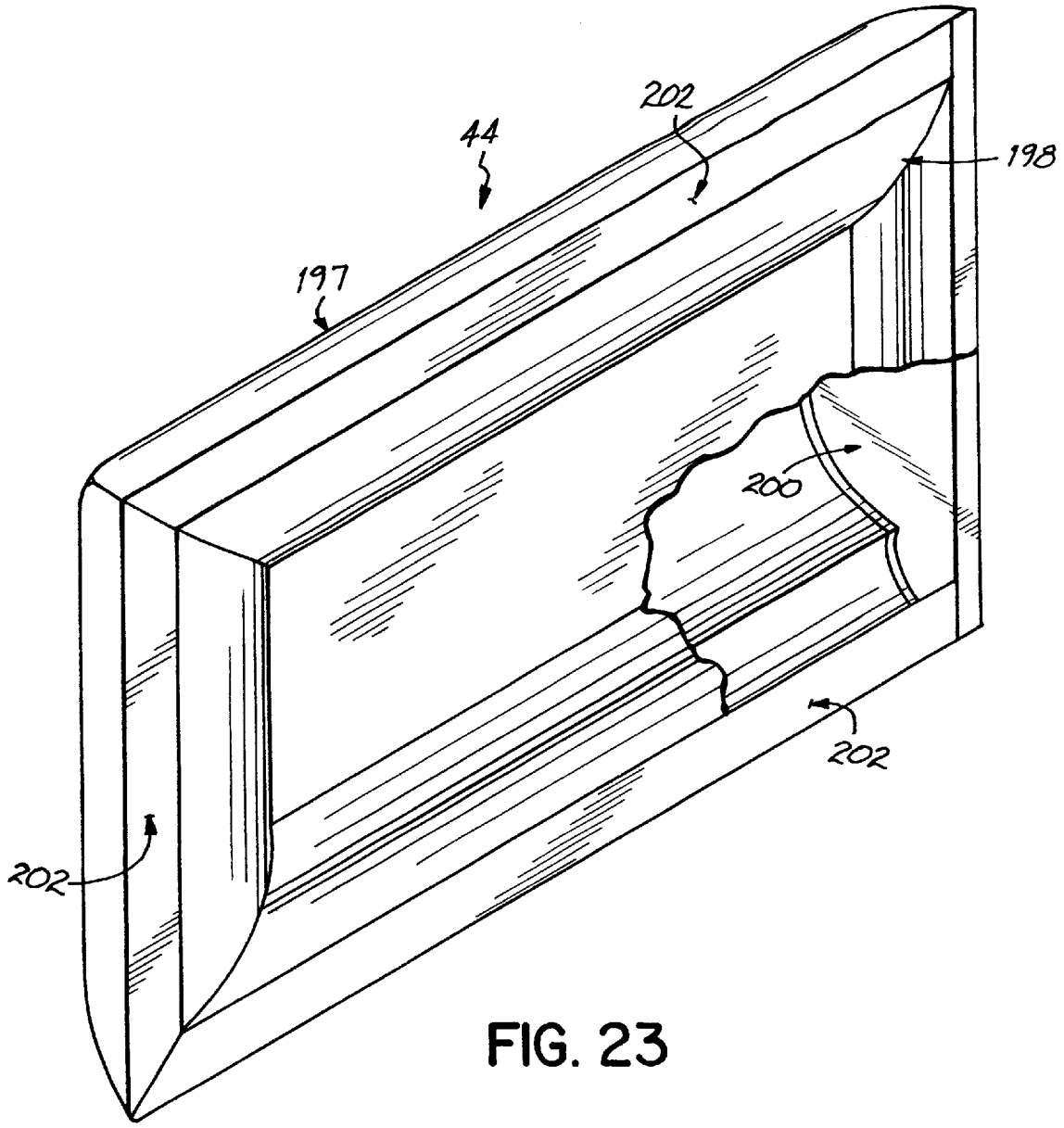
FIG. 23 is a bottom perspective view of a portion of the cover of the casket in accordance with the principles of the present invention.

After the assembly of the shell 22 is complete, the cover 40 (FIG. 17) must be assembled. The cover 40 is comprised of a lower, or foot, section 42 and an upper, or head, section 44. The sections 42, 44 are similar in construction; and therefore, only the construction of the upper section 44 will be described in detail. Referring to FIGS. 17 and 23, the upper section 44 includes a cap 197 that provides an exterior finish for the upper section 44. Inside the cap 197 is a dish 198 that provides a decorative fabric-like appearance. The inner end of the upper section 44 is terminated by a header piece 200. The cap 197 is preferably formed from a single piece of prefinished sheet metal, for example, prefinished 20 gauge steel, that has been stamped to provide the desired external shape and appearance of the upper section 44. The dish 198 may be manufactured in accordance with known techniques, that is, attaching a shirred fabric to a chip board or pressed board backing with staples or other fasteners, so that the desired shape and structure of the dish 198 is provided. In other embodiments, the dish 198 may be vacuum formed from a plastic material with a desired pattern, if any, molded directly into the dish material. Consequently, with that embodiment, the dish 198 is a single molded plastic piece having a molded surface texture that very closely simulates the texture of a shirred fabric. Such a dish is the subject of the assignee's copending design patent application filed on even date herewith entitled Molded Casket Dish, Ser. No. 29/108026, and the entirety of which is hereby incorporated by reference herein. The edges of the metal cap 197 and the dish 198 are mechanically secured by using a frame 202 that extends around three sides of the cap 197 and dish 198.

Figure 24A:
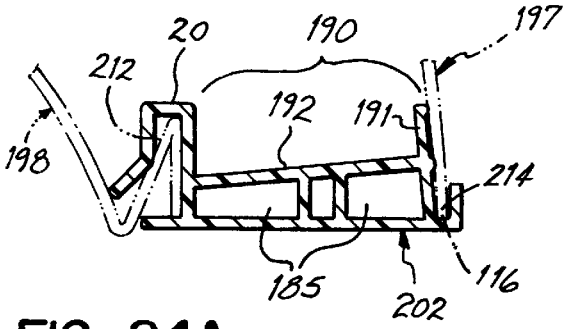
FIG. 24A is a cross-sectional view taken along line 24—24 of FIG. 17 and illustrates one embodiment of a peripheral frame that is used to join the edges of the external cap and internal dish in accordance with the principles of the present invention.

Referring to FIG. 24A, in one embodiment, the frame 202 is an extrusion that is identical to the shell cap extrusion 172 illustrated in FIG. 18. As will be appreciated, the frame 202 can be made to its desired U-shape by fabricating corners in a manner similar to the corner constructions described in FIGS. 19–22. If the dish 198 is a standard chip board and fabric construction, the frame extrusion 202 has a slot 210 extending longitudinally along the inner of the periphery of the frame 202, and the slot 210 is sized to receive a peripheral V-shaped edge 212 of the chipboard dish 198. The frame extrusion 202 has a second slot 214 extending longitudinally along the outside of its periphery; and the slot 214 is sized to receive a peripheral edge 216 of the cap 197. The edges 212, 216 are normally secured within their respective slots 210, 214 with an adhesive.

Figure 24B:
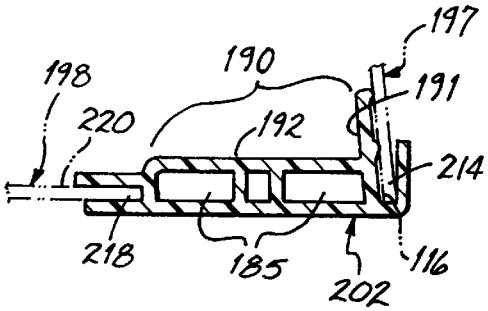
FIG. 24B is a cross-sectional view taken along line 24—24 of FIG. 17 and illustrates a second embodiment of a peripheral frame member for joining the peripheral edges of the cap with the dish.

If the dish 198 is a molded dish, referring to FIG. 24B, the frame extrusion 202 has a slot 218 extending longitudinally along the inner of the periphery of the frame 202, and the slot 218 is sized to receive a peripheral edge 220 of the molded dish 198. The extrusions 202 of FIGS. 22A and 22B are similar in that they both have a slot 214 for receiving an edge 216 of the cap 197. In FIG. 24B, the edges 216, 220 are normally secured within their respective slots 214, 218 with an adhesive. As will be appreciated, the frame extrusion 202 of FIG. 24B can be made to its desired U-shape by making corners as described with respect to FIGS. 18–20.

Figure 25:
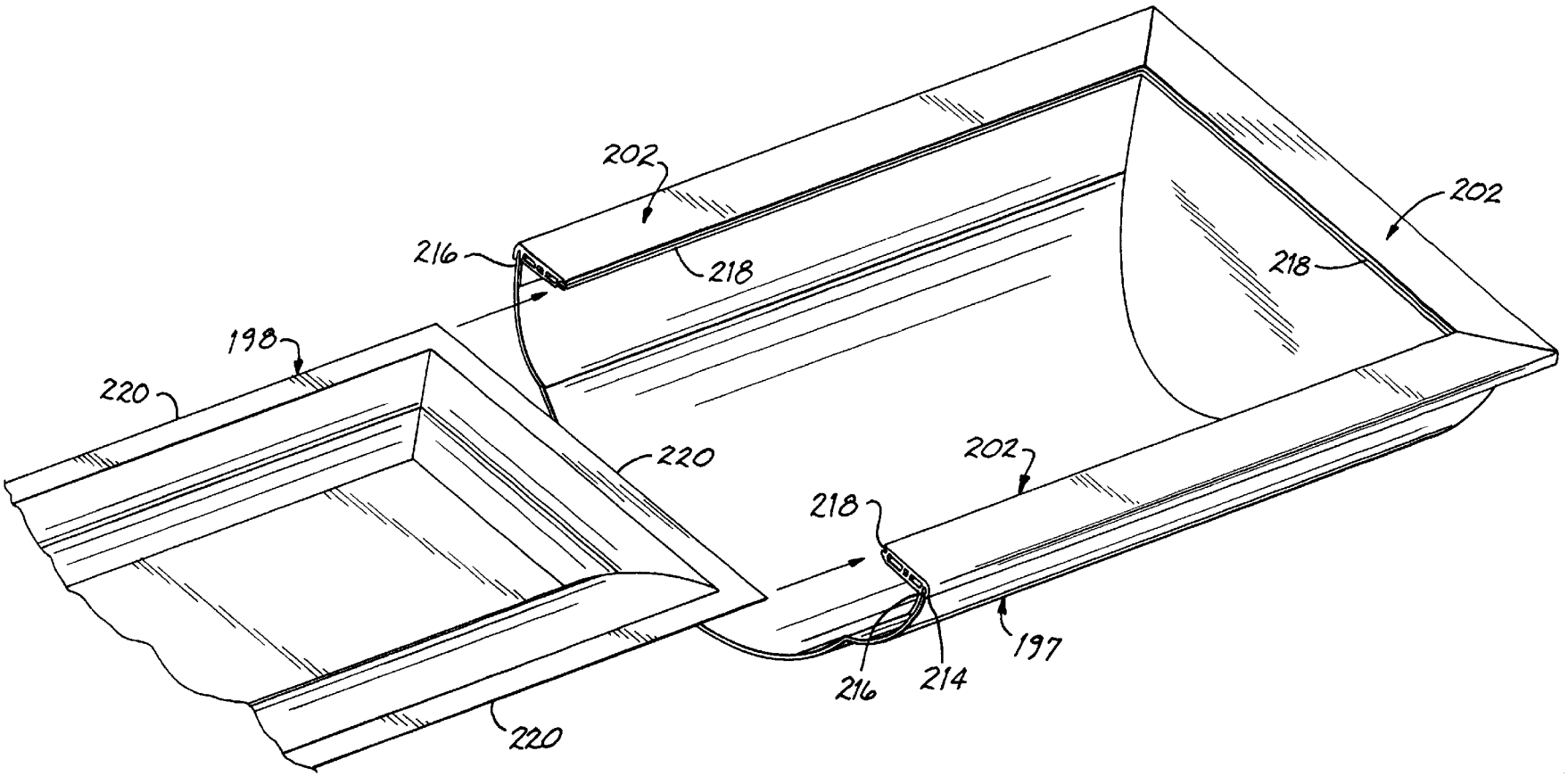
FIG. 25 is a perspective view illustrating how a molded dish and cap are assembled with a U-shaped frame.

Referring to FIG. 25, if the dish 198 is vacuum molded, it must be mounted in the U-shaped frame 202 prior to the assembly of the header 200 (FIG. 23). Therefore, as shown in FIG. 25, the U-shaped frame 202 is first constructed, and then the peripheral edge 216 of the cap 197 is glued into the slot 214 of the frame 202. Thereafter, the edge 220 of the dish 198 can be slid into the slot 218 of the frame 202. However, if the dish 198 is chipboard, it can be mounted in the frame 202 after the assembly of the header 200 to the cover 44.

Figure 26:
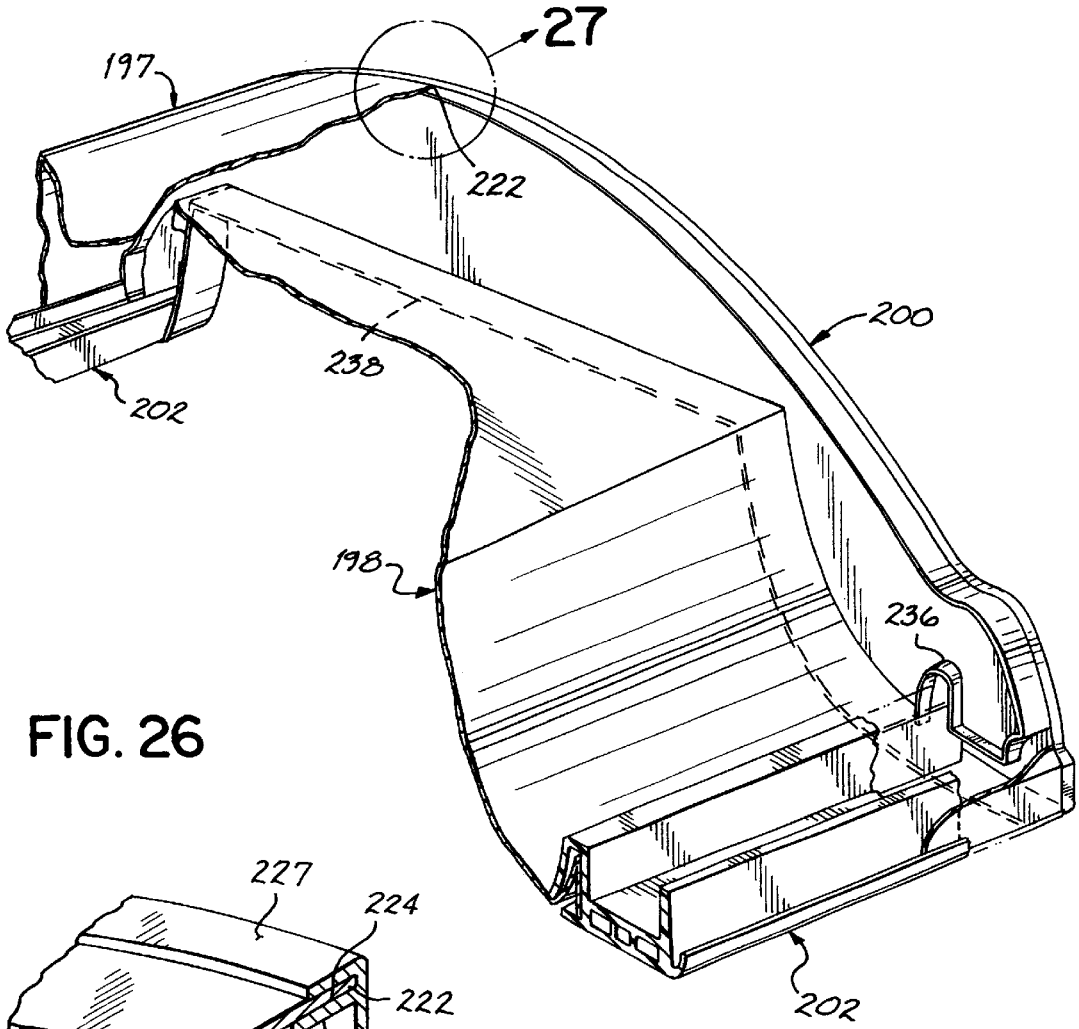
FIG. 26 is a partial perspective view illustrating one embodiment of a connection between a header and a cap in accordance with the principles of the present invention.

Referring to FIG. 26, the assembly of the sheet metal cap 197 to the header 200 must be accomplished so that the end edge 222 of the sheet metal cap 197 is not exposed, and the header and cap assembly present a desired appearance. The header 200 is preferably molded, for example, injection molded, from a plastic material. Therefore, the connection of the header 200 to the cap 197 can be accomplished with several different constructions.

Figure 27A:
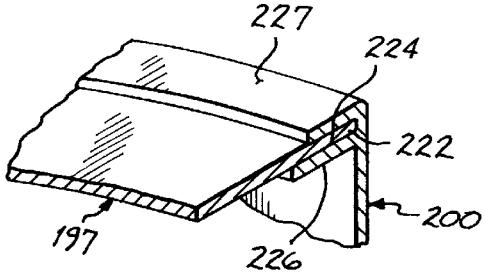
FIG. 27A is a partial perspective view of encircled area 27 of FIG. 26 illustrating one embodiment of a connection between an edge of a header and an adjacent end edge of a cap in accordance with the principles of the present invention.
Figure 27B:
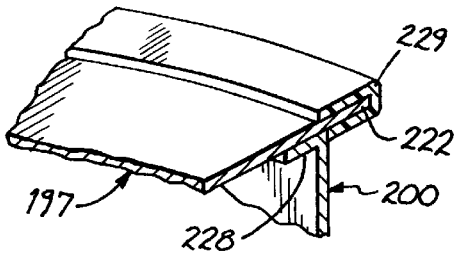
FIG. 27B is a partial perspective view of encircled area 27 of FIG. 26 illustrating another embodiment of a connection between an edge of a header and an adjacent end edge of a cap in accordance with the principles of the present invention.
Figure 27C:
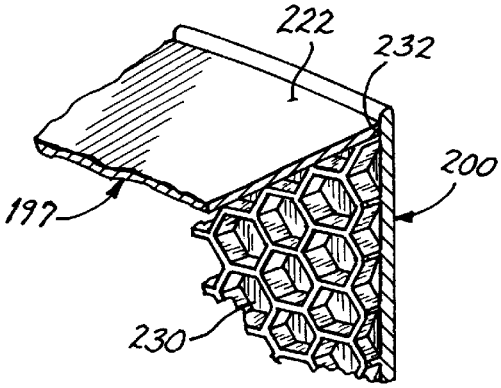
FIG. 27C is a partial perspective view of encircled area 27 of FIG. 26 illustrating a further embodiment of a connection between an edge of a header and an adjacent end edge of a cap in accordance with the principles of the present invention.

Referring to FIG. 27A, with a first embodiment, the header 200 is injection molded to have a peripheral slot 224 between a flange 226 and an outer peripheral lip 227. The slot 224 is sized to receive the end edge 222 of the sheet metal cap 197. The end edge 222 is normally secured in the slot 224 with an adhesive. An alternative construction is illustrated in FIG. 27B in which the header 200 is manufactured from pre-finished sheet metal or a molded plastic material. In this embodiment, the end edge 222 of the sheet metal cap 197 overlaps the outer peripheral lip 228 of the header 200. The portion of the end edge 222 extending past the outer surface of the header 200 is covered with an edge molding 229. Normally, the lip 228 of the header 200 is secured to the inner surface of the cap 197 by an adhesive. Referring to FIG. 27C, in a third embodiment, the sheet metal or plastic header 200 has a honeycomb or other semi-rigid material 230 glued to its inner surface at a location to form a peripheral notch or channel 232. The notch 232 receives and supports the end edge 222 of the sheet metal cap 197, and an adhesive is used to bond the cap 197 and header 200 together.

As illustrated in FIG. 26, the header 200 has an interior wall or projection 236 under which an end of the frame 202 is inserted during the assembly of the header 200 with the frame 202. The wall 236 has a profile generally matching the profile of the frame 202. The frame 202 being a plastic extrusion has a coefficient of expansion greater than the metal cap 197. Thus, the wall 236 must have a height, that is, extend out from the header 200, a sufficient amount to hold the frame 202 within the header 200 over the expected range of longitudinal contraction and expansion of the frame 202. Normally, the end of the dish 198 is adhered to the outer directed surface of a flange 238 on the inner surface of the header 200 as illustrated in FIG. 26. As will be appreciated, instead of being injection molded, the header 200 can be stamped from a 24 gage prefinished sheet metal that is used to make the cap 197. With this embodiment, the header is limited to having an outer peripheral lip such as lips 227, 228 of FIGS. 27A and 27B under which the end edge of the cap 197 would be attached by welding, bonding or other means. Further, with a metal header 200, the support 236 is made separately from metal or plastic and attached to the sheet metal header by welding, bonding or other means.

Figure 28:
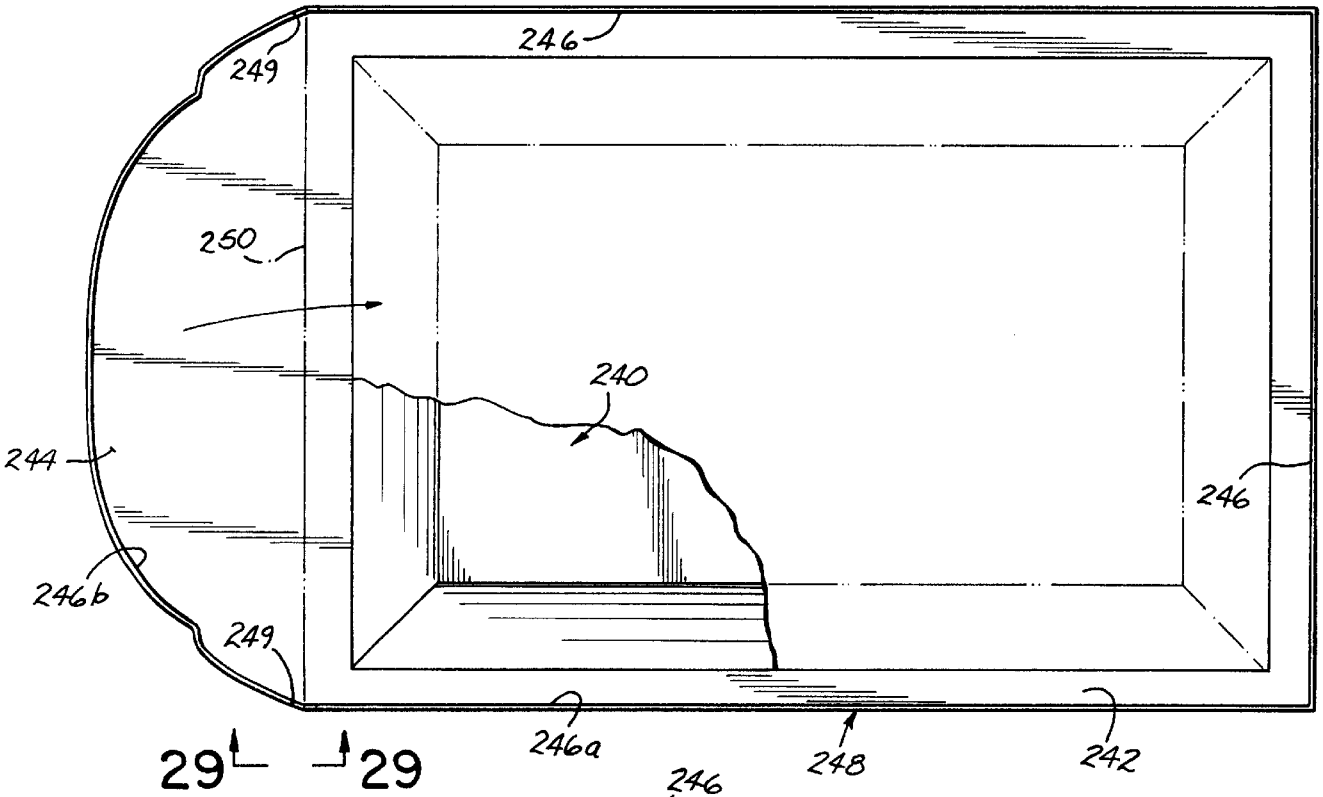
FIG. 28 is a partial plan view of an integral header and dish molded as a single piece and the header in an unfolded position in accordance with the principles of the present invention.
Figure 29:
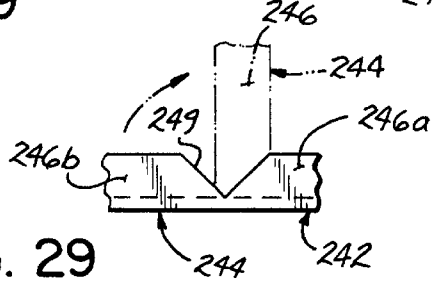
FIG. 29 is a partial elevation view of area 29—29 of FIG. 28 illustrating the integral header and dish of FIG. 28 and illustrating how the header is folded 90° with respect to the dish.
Figure 30:
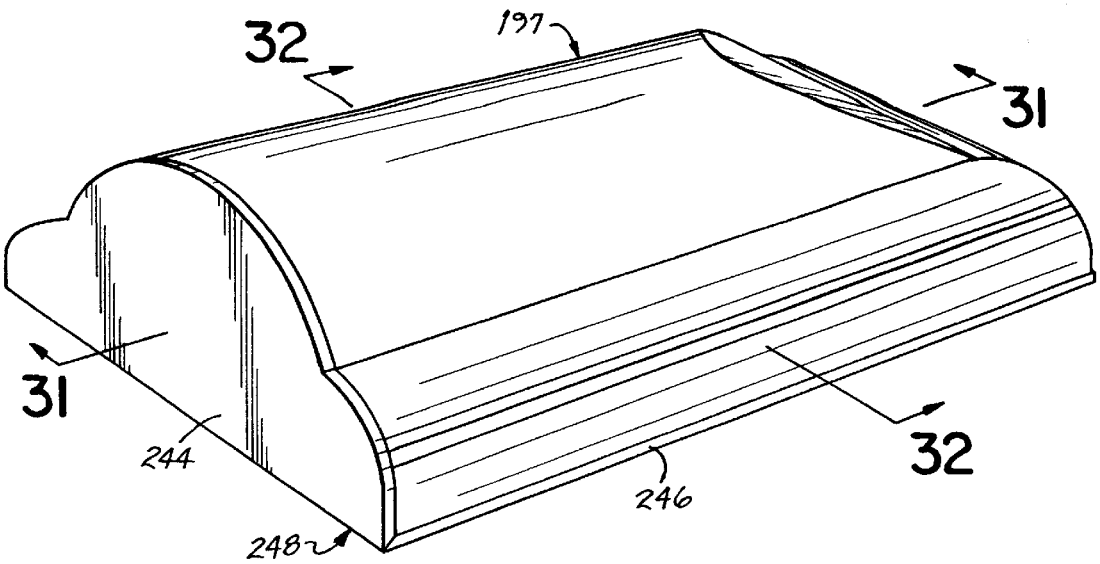
FIG. 30 is a partial perspective view of the integrally molded header and dish assembled with a cap in accordance with the principles of the present invention.
Figure 31:
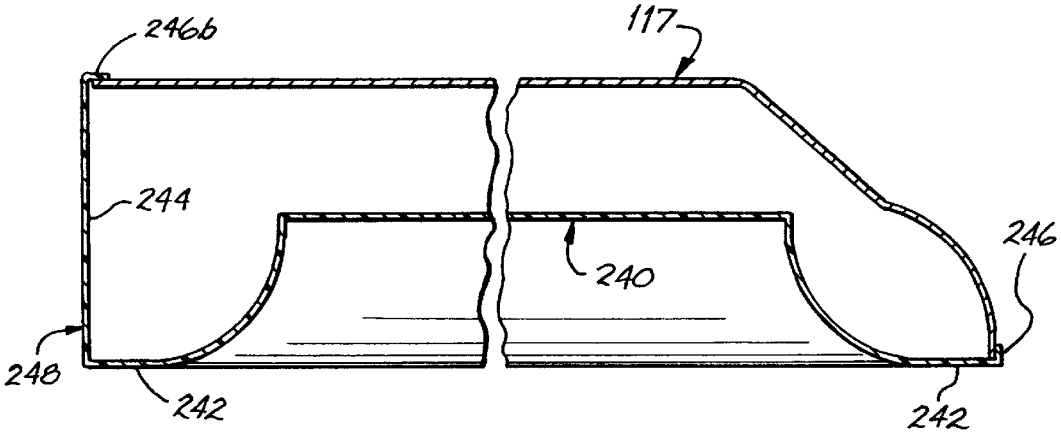
FIG. 31 is a cross-sectional view taken along line 31—31 of FIG. 30 illustrating a longitudinal cross-section of a molded header and dish assembled with the cap.
Figure 32:
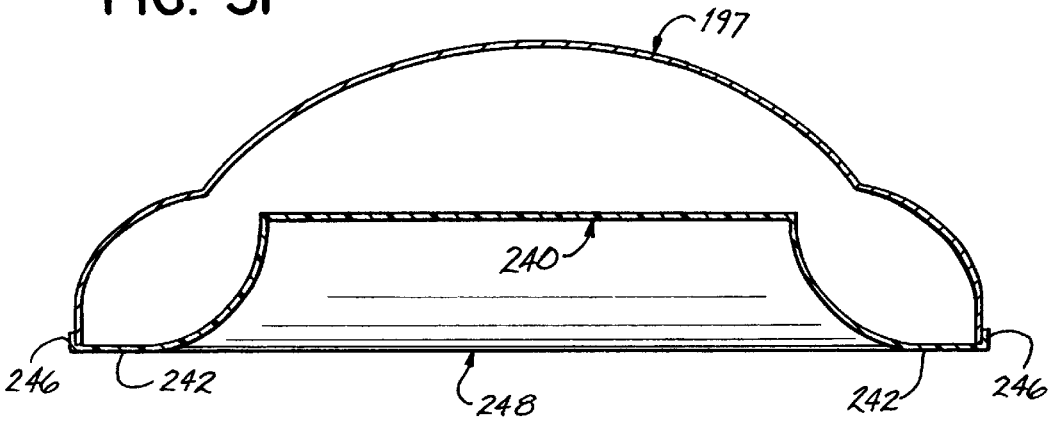
FIG. 32 is a cross-sectional view taken along line 32—32 of FIG. 30 illustrating a front to back cross-section of the molded header and dish assembled with the cap.

A simplified dish and header construction is illustrated in FIG. 28. In this embodiment, a dish 240, peripheral frame 242, header 244 and peripheral cap retaining lip 246 are formed together as an integral unit 248. The integral unit 248 is normally vacuum formed out of a plastic material having score lines 250 corresponding to the edge to be folded during the assembly process. The lip 246 has a first lip portion 246*a* extending around the periphery of the frame pieces 242 and a second lip portion 246*b* extending around the header 244. The lip portions 246*a* and 246*b* are separated by right angle notches 249. Referring to FIG. 29, during assembly, the header 244 is folded 90° along score line 250, and the sides of the notches 249 come together to form the continuous lip 246. The sheet metal cap 197 is then fitted beneath a molded peripheral flange or lip 246 on the header 244, as well as behind the lips 246 extending along the three linear sides of the integral unit 248. The fully assembled cap unit as partially illustrated in FIG. 30 has the longitudinal and front-to-back cross-sectional profiles illustrated in FIGS. 31 and 32, respectively. The cap 197 and integral dish and header unit 248 are secured together with an adhesive. As illustrated in FIG. 28, the lip 246 may be molded into its final right angle relationship to the frame sections 242; however, as will be appreciated, alternatively, the lip 246 may molded as individual pieces that are coplanar with frame sections 242. In this embodiment, a score line separates the individual lip pieces from adjacent frame sections; and the individual lip pieces are folded 90° along the score line to form a continuous lip similar to the molded lip 246 illustrated in FIG. 28.

Figures 33, 34:
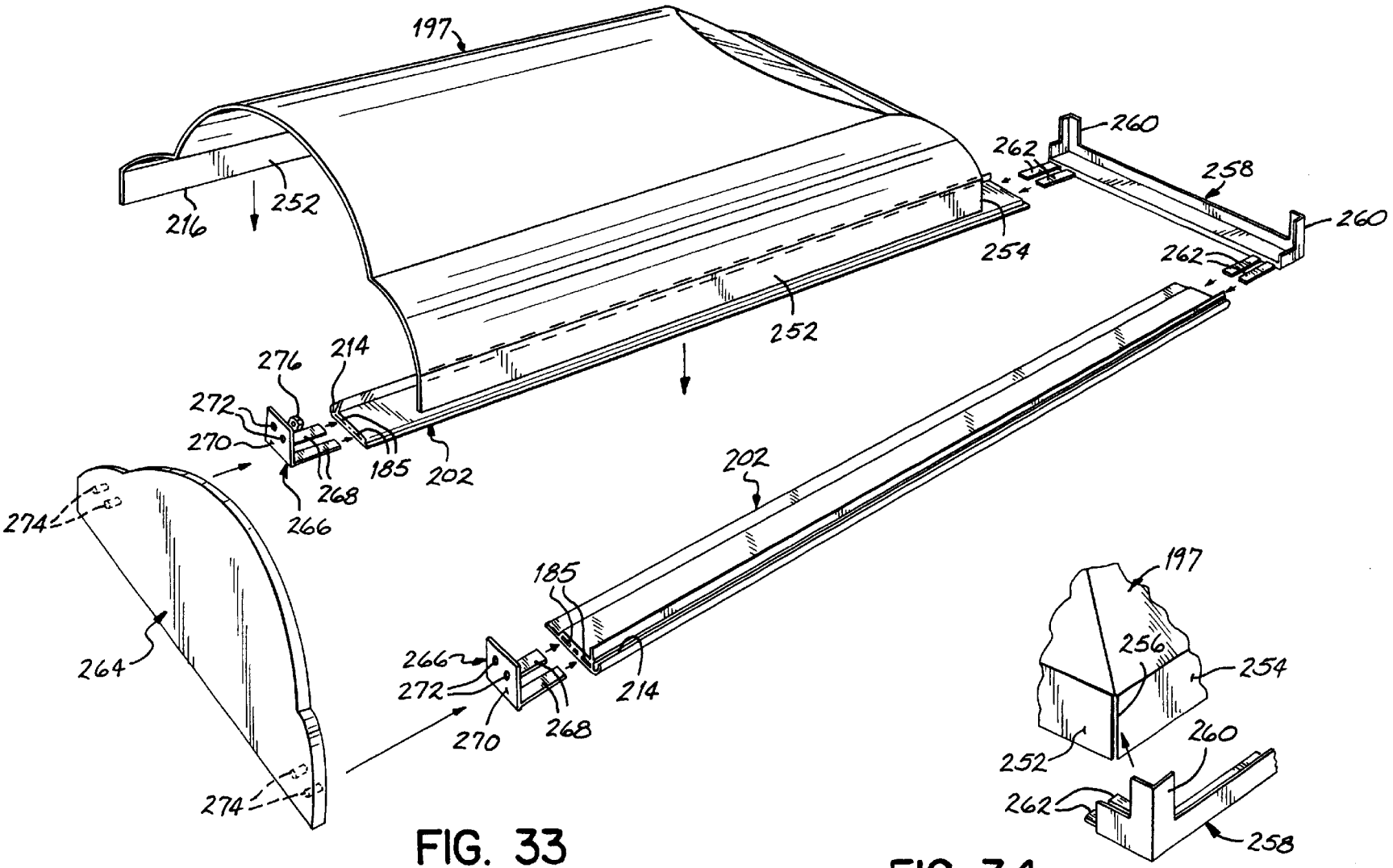
FIG. 33 is a perspective view of an other embodiment of a casket cover frame in accordance with the principles of the present invention with the casket cover components being shown disassembled.
FIG. 34 is a partial perspective disassembled view of a cap corner of the embodiment shown in FIG. 33.

FIGS. 33 and 34 illustrate a still further embodiment of a casket cover assembly. In this embodiment, a sheet metal cap 197 is formed in a manner as previously described. Further, the peripheral edges 216 are disposed in slots 214 of the cap frame members 202 in a manner similar to that described with respect to FIG. 24B. The cap 197 is drawn or stamped to have lower side walls 252 and a lower end wall 254. Preferably, the cap 197 is drawn or stamped so that a gap 256 is formed at the corners formed by the end wall 254 and side walls 252. Normally, the corner is finished by welding the side and end walls 252, 254 together and thereafter, grinding the welded corner to the desired finish. That process is expensive and labor intensive and preferably avoided if possible. Thus, with this embodiment, the cap frame includes an end frame member 258 that has right angle moldings or trim pieces 260 extending upward from the member 258. The trim pieces 260 have a size and shape to cover the gap 256 upon the cap 197 being assembled into the cap frame 202. The end member 258 is preferably injection molded with tabs 262 that are sized to fit into the slots 185 (FIG. 24B) of the cap frame members 202. However, as will be appreciated, the end cap frame member 258 may also be fabricated from sheet metal and provide similar benefits.

FIG. 33 further illustrates an alternative embodiment for attaching a header 264 to the side pieces of the cap frame 202. In this embodiment, separate connecting brackets 266 are fabricated from plastic or sheet metal and have tabs 268 that are sized to fit within the slots 185 (FIG. 24A) of the side members of the cap frame 202. The brackets 266 further have a connecting plate 270 with holes 272 that are sized to receive fastener elements 274 on the inner side of the header 264. The fastener elements 274 may be secured within the respective holes 272 by fastening clips (not shown) in a known manner. Alternatively, the fastener elements 274 may be threaded shafts and secured within the respective holes 272 by threaded nuts 276 (only one being shown) in a known manner. Thus, the header 264 may be fabricated from sheet metal or plastic, and the fastener elements 274 likewise fabricated of metal or plastic material and interconnected as described above with the brackets 270 that also are fabricated from a metal or plastic material.

Figure 35:
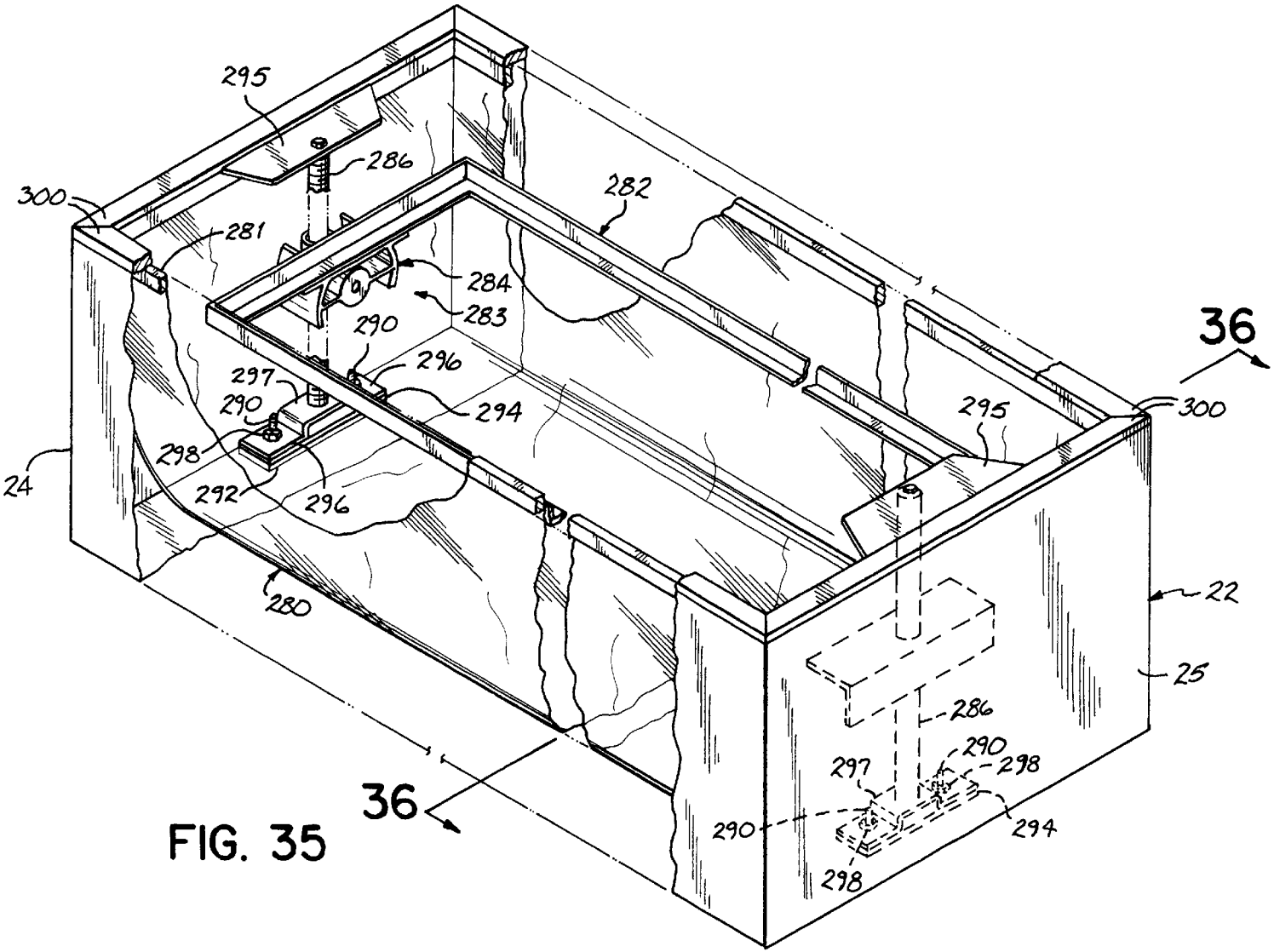
FIG. 35 is a partially broken away perspective view of a casket interior that includes a fluid bag liner and a bed lift mechanism in accordance with the principles of the present invention.
Figure 36:
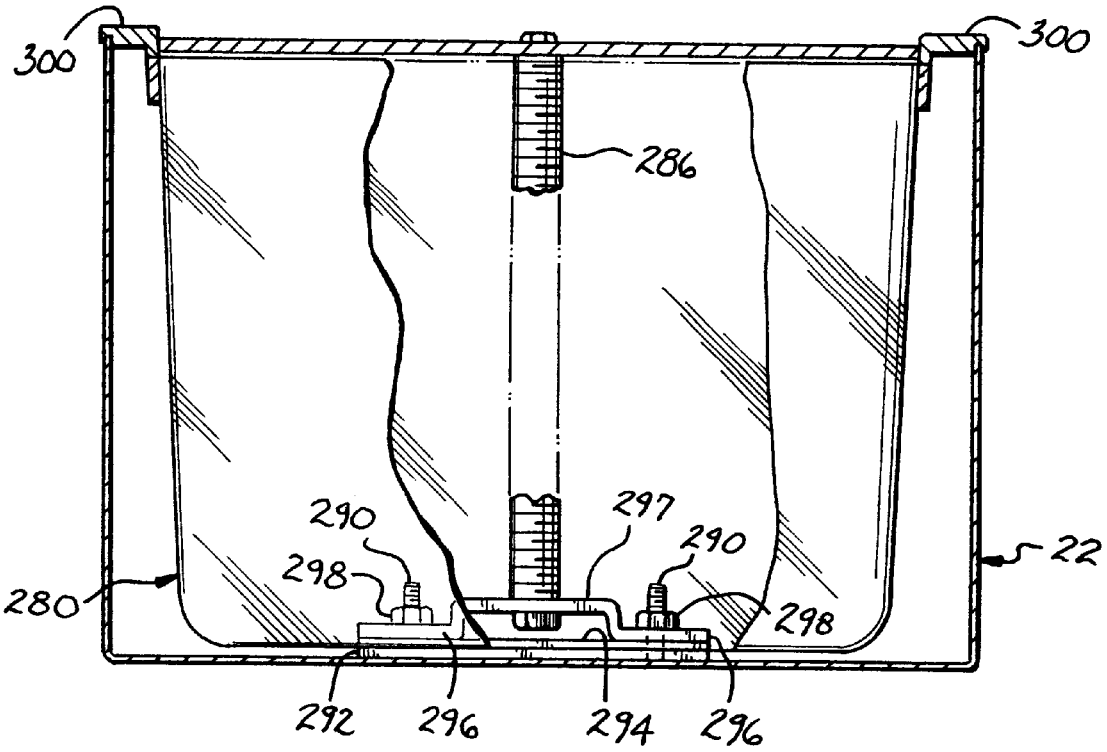
FIG. 36 is a cross-sectional view taken generally along line 36—36 of FIG. 35 illustrating the assembly of the bed lift mechanism with the fluid bag liner.

Referring to FIGS. 35 and 36, the casket of the present invention further includes a bed lift mechanism disposed inside a liquid tight or impervious liner 280 within the casket shell 22. The liner 280 is normally made of a plastic film material and has a rim 281 of a heavier material, for example, paperboard, extending completely around the upper edge of the liner 280. The rim 281 is attached at the top of the inside surfaces of the end and side walls 24, 25 with an adhesive or other means. A bed lift mechanism 283 is of a known type and more fully disclosed in the commonly assigned U.S. Pat. No. 5,592,724 which in its entirety is hereby incorporated by reference herein. A bed frame 282 is supported on each end by a movable bracket 284 that is threadedly attached to a lift screw 286. By rotating the lift screw 286, a respective end of the bed frame 282 is raised or lowered to a desired height. The lift screw 286 is supported at its upper end by an upper bracket 295 and at its lower end by a lower bracket 297. The lower bracket 297 is secured by fastener bodies or shafts 290 which are welded at their lower ends to the bottom 26 of the casket shell 22. The shafts 290 extend through holes within a first gasket 292 located between the bottom 26 of the shell 22 and the bottom of the liner 280. The shafts 290 extend through the bottom of the liner 280 and through a second gasket 294 disposed on the upper bottom surface on the interior of the liner 280. The shafts 290 extend through mounting flanges 296 of bracket 297 and fasteners 298 secure the assembly together. The gaskets 292, 294 provide seals that prevent any fluid within the liner 280 from leaking. The fastening shafts 290 and fasteners 298 may be made from any known fastener material and preferably are rust resistant. Alternatively, the fastener shafts 290 may be plastic shafts either smooth or threaded, and the fasteners 298 may be either clips or plastic threaded nuts. As will be appreciated, any combination of metal and/or plastic shafts 290 can be used with plastic or metal clips or nuts 298.

The upper end of the screw 286 may be secured to the casket shell 22 in several ways. For example, the lift screw bracket 295 may be welded, bonded or otherwise adhered to the inside surface of the end wall 24 of the casket shell 22. Alternatively, the screw bracket 295 may have connecting flanges similar to the bracket 297 that are disposed over fastening shafts extending from the end wall 24 in a manner similar to the shafts 290 that extend from the bottom of 26 of the shell 22. Alternatively, the lift screw bracket 295 may be fabricated as an integral part of the shell rim frame member 300. The shell frame member 300 may be fabricated from metal and have a cross-sectional profile similar to that illustrated in FIG. 18. Preferably, the shell rim frame member 300 is an injected molded piece having a cross-sectional profile similar to that shown in FIG. 18 and including the upper lift screw bracket 295.

Figure 37:
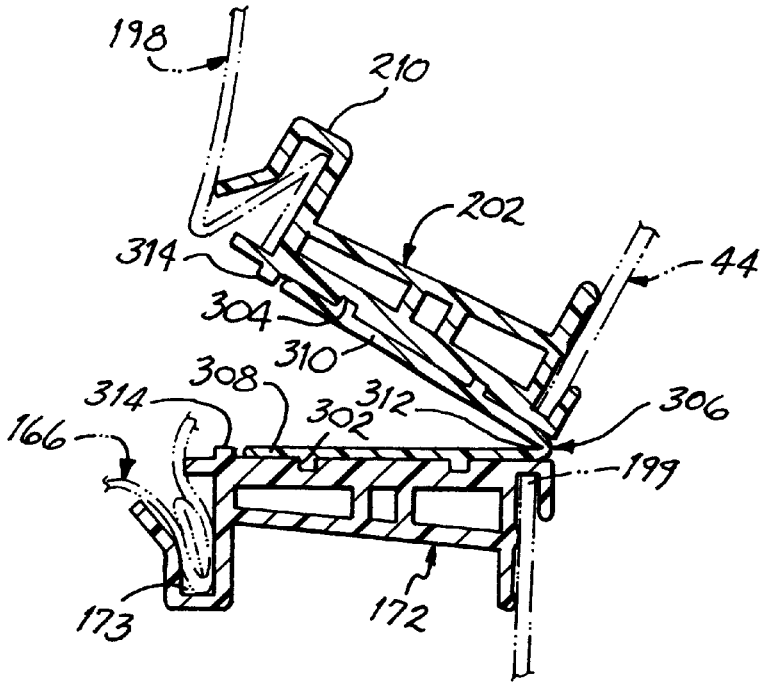
FIG. 37 is a partial cross-sectional view of a hinge extending along a rear edge of a casket and pivotally connecting a casket cover with a casket shell in accordance with the principles of the present invention.

In accordance with one embodiment of the casket of the present invention, the upper cover 44 is hinged to the shell 22 using a living hinge illustrated in FIG. 37. The upper edge 199 is finished with an extrusion 172 similar to the extrusion illustrated in FIG. 18 which has a slot 173 for securing the fabric 166 on the shell. The upper cover has a frame extrusion 202 similar to those illustrated in FIGS. 24A, 24B for securing the peripheral edges of the cap 197 and dish 198. The extrusions 172, 202 have slots 302, 304 respectively, in opposed surfaces within which an extruded plastic hinge 306 is mounted. The extruded plastic living hinge 306 is preferably secured to the frame extrusions 172, 202 by an adhesive. The living hinge 306 is comprised of opposed members 308, 310 which are connected along one edge 312. In this embodiment, extruded frame members 172, 202 have respective opposed bosses 314 which come into contact when the cover 44 is closed over the shell 22. Thus, the bosses 314 provide a fixed relationship between the extruded frame members 172, 202 around the entire periphery of the casket.

Figure 38:
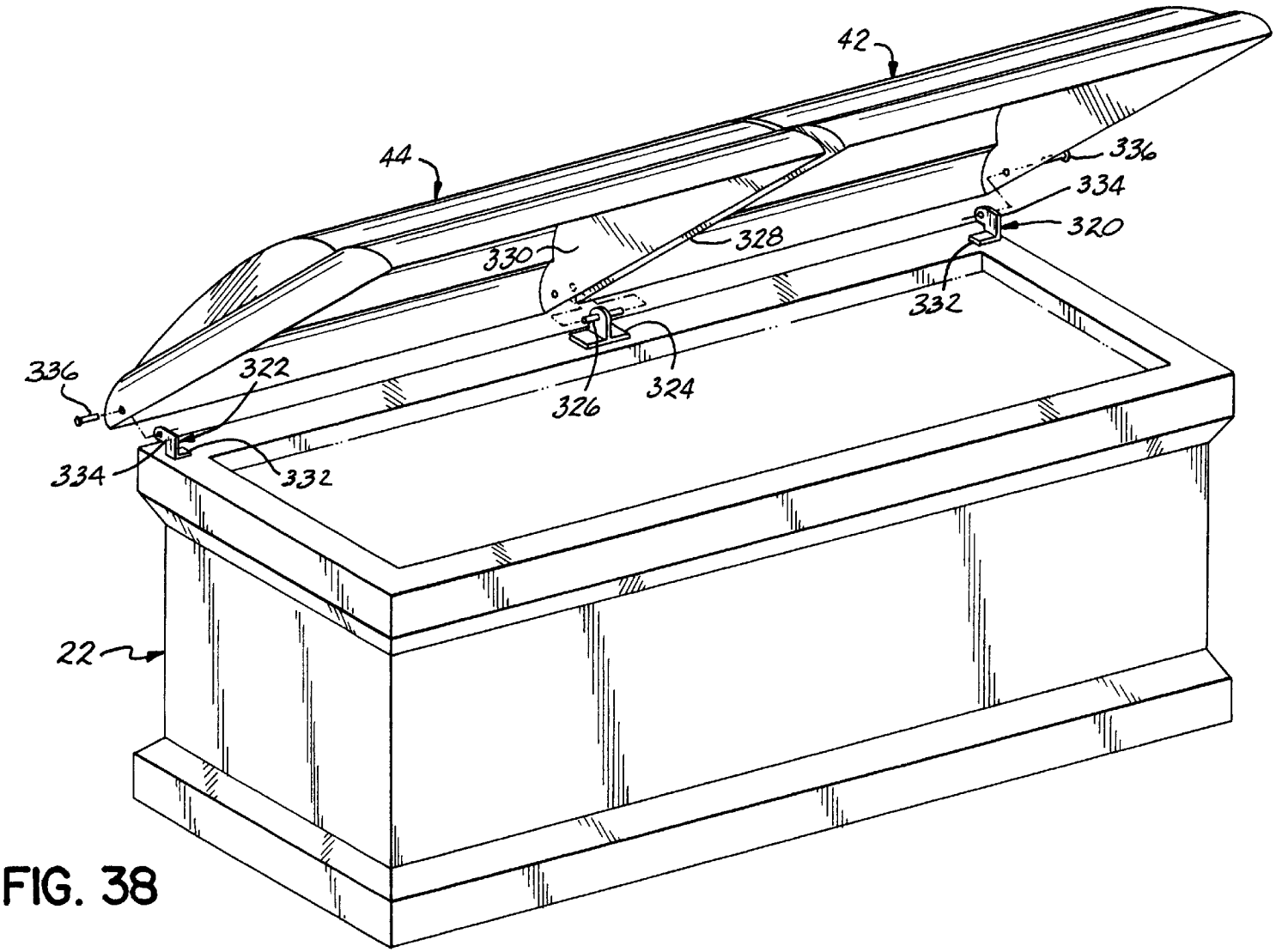
FIG. 38 is a disassembled perspective view of a casket shell and cover illustrating one embodiment of a hinge system for pivotally connecting the casket cover to the shell in accordance with the principles of the present invention.

FIG. 38 illustrates an alternative embodiment for hinging the casket covers 42, 44 to the casket shell 22. The covers 42, 44 are pivotally supported on respective L-shaped end brackets 320, 322 and a centrally located bracket 324. An adjacent hinge pin 326 extends from both sides of the bracket 324 and into holes within the headers 328, 330 of the respective covers 42, 44. A base flange 332 of each of the end brackets 320, 322 is secured to an upper surface of the rear edge of the casket shell 22 by fasteners, adhesives or other known securing means. A perpendicular, generally vertical flange 334 on each of the end brackets 320, 322 receives a hinge pin 336 extending through an exterior end surface of the covers 42, 44. The pins 336 are shoulder bolts that have a smooth shoulder immediately beneath a decorative head of the pin for providing a bearing surface for the pivoting motion of the cover 42. The ends of the hinge pins 336 are threadedly engaged with the vertical flanges 334.

Figure 40:
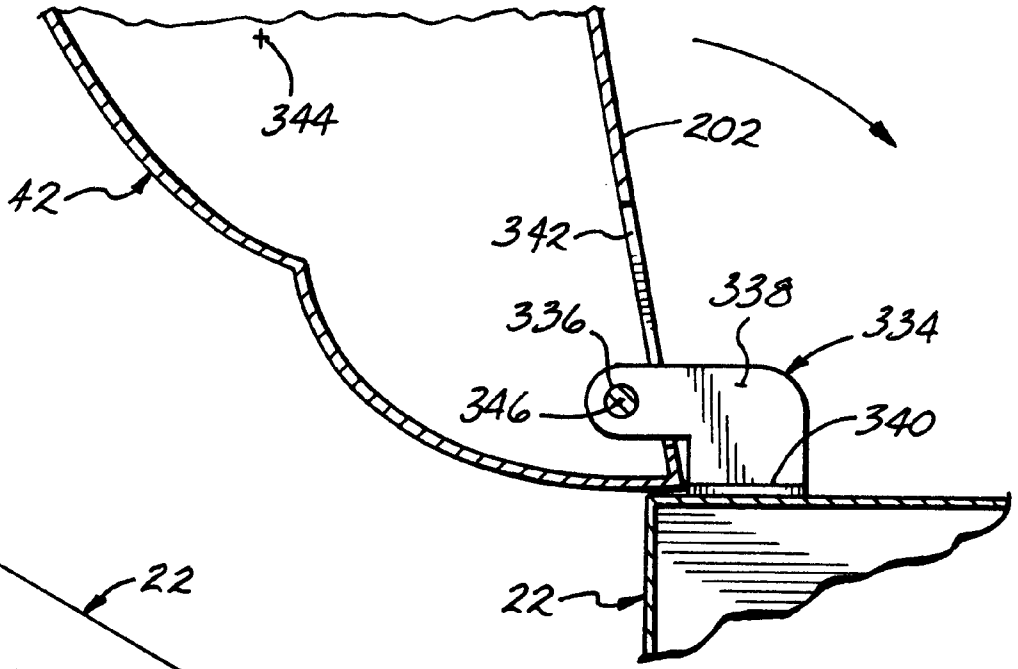
FIG. 40 is a cross-sectional view taken along lines 40—40 of FIG. 39 illustrating the casket cover maintained in the open position by the hinge of FIG. 38.
Figure 39:
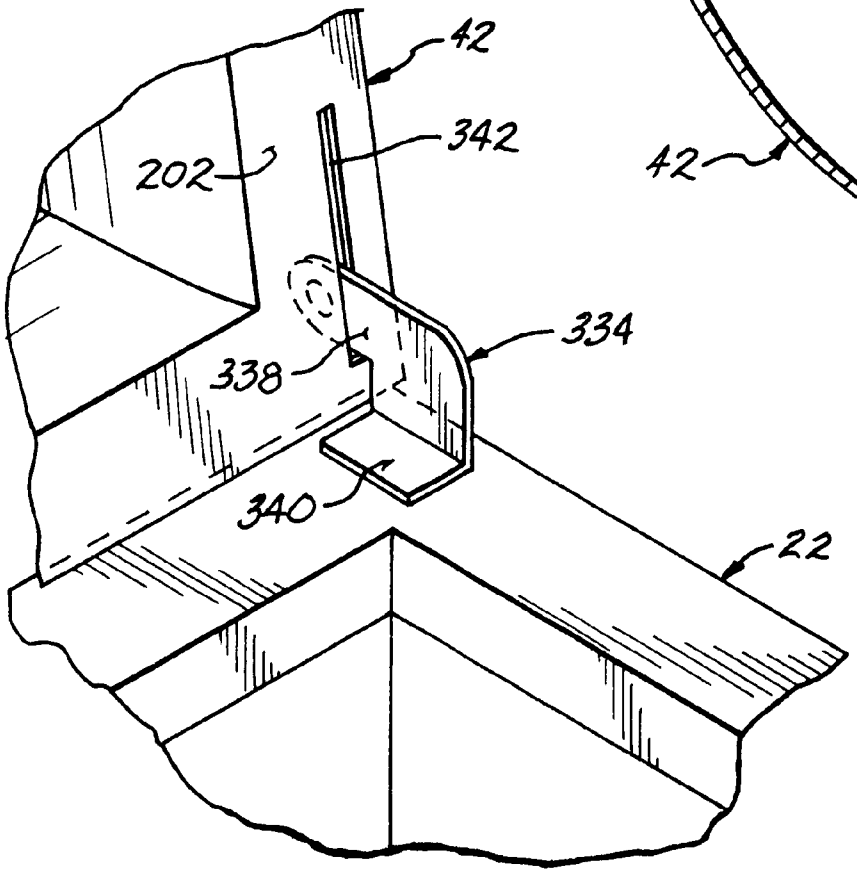
FIG. 39 is a partial perspective view of a casket shell and cover using the hinge of FIG. 38 with the cover in the open position.

Referring to FIG. 39, the vertical flanges 334 are L-shaped and consist of a vertical leg 338 and a rearward horizontal leg 340 that extends into a slot 342 in a frame member 202 of the casket cover. Thus, the working portions, or pivot portions, of the hinge brackets 320, 322 and pins 336 are hidden from view. A further advantage of that hinge construction is that the frame member 202 operates as a stop as illustrated in FIG. 40. The length of the horizontal member 340, that is, the distance from the pivot pin 336 from the rear edge of the vertical member 338, must be sufficient to permit the cover 42 to open far enough such that its center of gravity 344 pivots past or rearward of the pivot axis 346. Once the center of gravity 344 is rearward of the pivot axis 346, the cover 42 will tend to continue to rotate rearwardly. However, engagement of the outer surface of the frame member 202 against the rearward edge of the hinge bracket member 338, forms a stop prohibiting further rotation of the cover 42. Thus, the cover may be raised to the position illustrated in FIG. 40, and it will remain in the open position until manually closed.

Figure 41:
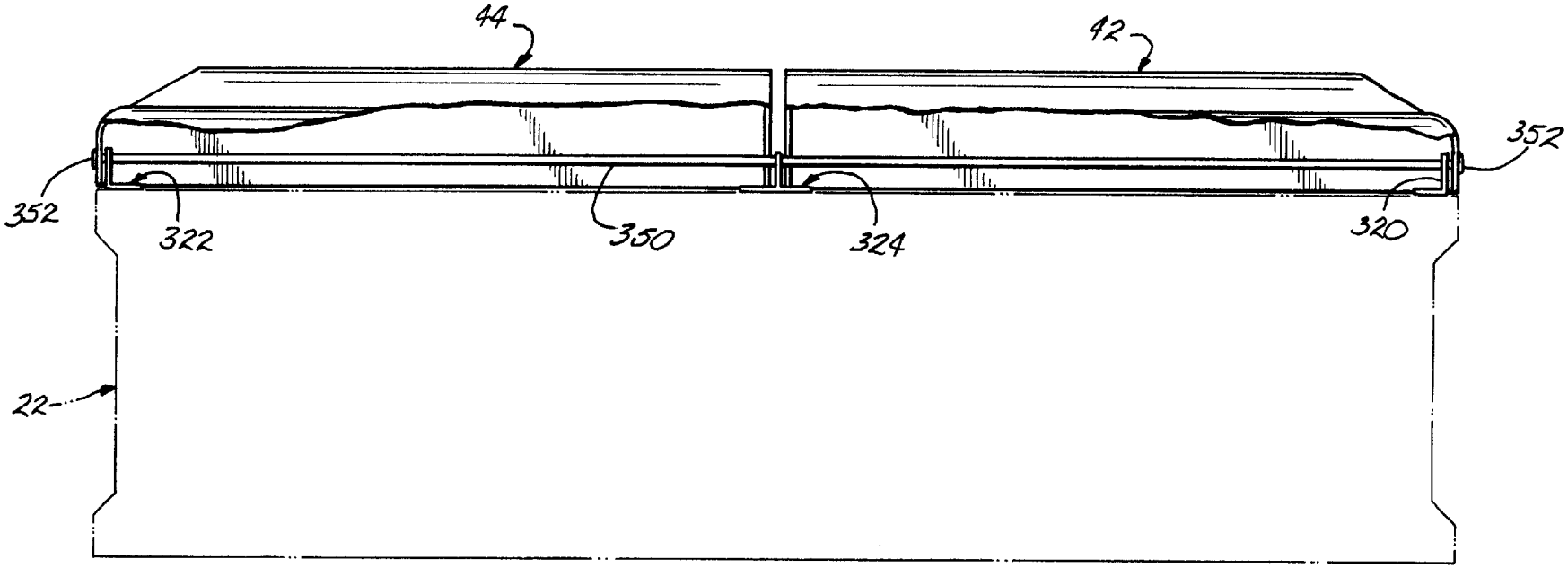
FIG. 41 is a partially broken-away side elevational view of a casket shell and cover illustrating an alternative embodiment of a hinge system for pivotally connecting the casket cover to the shell in accordance with the principles of the present invention.

FIG. 41 illustrates an alternative embodiment in which the various hinge pins 326, 336 of FIG. 38 are replaced by a single rod 350. The hinge rod 350 extends through the one end of the casket cover 44, through the hinge bracket 322, through the other end of cover 44, through hinge bracket 324, through one end of the cover 42, through the hinge bracket 320 and through the other end of the cover 42. The ends of the hinge or pivot rod 350 are then covered with decorative caps 352 which also function to maintain rod 350 in its desired longitudinal position. The hinge brackets 320, 322, 324, hinge pins 326, 336 and the hinge rod 350 may be made from any appropriate material either combustible or noncombustible. For example, the hinge brackets 320–324 may be made from a decorative metal such as cast zinc or brass. Alternatively, the hinge brackets 320–324 may be made from plastic or wood. Similarly, the hinge pins 326, 336 and hinge rod 350 may be made from a metal, plastic or wood material. As will be appreciated, a mix of those materials may be utilized as desired. For example, the brackets 320–326 may be made of plastic and the hinge pins 326, 336 or rod 350 made of metal or wood, etc.

While the invention has been illustrated by the description of a preferred embodiment and while the embodiment has been described in considerable detail, there is no intention to restrict nor in any way limit the scope of the amended claims to such detail. Additional advantages and modifications will readily appear to those who are skilled in the art. For example, four walls 23 are shown intersecting to form a right angle corner; however as will be appreciated, in other casket constructions, the more than four walls 23 may be used which will intersect to form corners that are not at right angles. As will also be appreciated, a corner plate having a different shape may be used as described herein.

Therefore, the invention in its broadest aspects is not limited to the specific details shown and described. Consequently, departures may be made from the details described herein without departing from the spirit and scope of the claims which follow.

What is claimed is:

1. A casket comprising:

a plurality of metal walls;

a bottom connected to the walls to form a shell;

a liquid impervious liner disposed within the shell;

a bed lift mechanism disposed within the liquid liner and connected to the shell;

a first gasket located between the bed lift mechanism and the liner;

a second gasket located between the liner and the bottom of the casket; and a cover having a metal cap and mounted on upper portions of the walls to form a closure for the shell.

2. A casket of claim 1 wherein the liner is made from a plastic film.

3. A casket of claim 1 wherein the liner is attached to the walls.

4. A casket of claim 1 wherein the liner is attached to the walls adjacent upper edges of inside surfaces of the walls.

5. A casket of claim 1 wherein the bed lift mechanism comprises a lift screw supported at its lower end by a lower bracket disposed adjacent one end of the liner.

6. A casket of claim 5 wherein the lift screw is supported at its upper end by an upper bracket connected to the shell.

7. A casket of claim 6 wherein the upper bracket is integral with an end wall of the shell.

8. A casket of claim 6 wherein the casket further includes a rim extending around an upper edge of the walls and the upper bracket is integral with a portion of the rim.

9. A casket of claim 8 wherein the upper bracket is integral with a portion of the rim contiguous with the end wall.

10. A casket of claim 1 further comprising a fastener having a body extending from the bottom through the second gasket, the liner, the first gasket and the lower bracket.

11. A casket of claim 10 wherein the fastener has one end connected to the shell.

12. A casket of claim 10 further comprising:

a second bed lift mechanism having a second lift screw supported at its lower end by a lower bracket disposed adjacent an opposite end of the liner;

a third gasket located between the lower bracket of the second bed lift mechanism and an the liner; and a fourth gasket located between the liner and the bottom; and a second fastener having a body extending from the bottom, through the fourth gasket, the liner, the third gasket and the lower bracket of the second bed lift mechanism.

13. A casket of claim 12 wherein the second fastener has one end connected to the shell.

14. A casket comprising:

a casket shell;

a liquid impervious liner disposed within the casket shell;

a first gasket having a first side positioned against the casket shell and having a second side disposed on an exterior side of the liner;

a second gasket having a first surface disposed on an interior surface of the liner;

a mounting flange for a bed lift mechanism having a bottom surface positioned adjacent a second surface of the second gasket;

a fastener extending through the first gasket, the liner, the second gasket, and the mounting flange, the first and second gaskets preventing liquid from leaking from inside the liner to the casket shell.

15. A method of mounting a bracket for a bed lift mechanism inside a liquid impervious liner disposed within a casket shell comprising:

disposing a first gasket between the casket shell and an exterior side of the liner;

juxtaposing a second gasket between an inner side of the liner and the bracket;

disposing a fastener through the first gasket, the liner, the second gasket and the bracket to form a liquid-tight seal between the gaskets and to prevent liquid from leaking from the liner into the casket shell.

* * * * *

UNITED STATES PATENT AND TRADEMARK OFFICE

CERTIFICATE OF CORRECTION

PATENT NO. : 6,301,758 B1
DATED : October 16, 2001
INVENTOR(S) : John P. Biondo

It is certified that error appears in the above-identified patent and that said Letters Patent is hereby corrected as shown below:

Title page,
Item [75], Inventors, change "John P. Biondo, Aurora; Carl J. Holbert; Walter A, Hullemeyer, both of Batesville; Leonard D. Kincer, Sunman; Louis J. Scheele, Batesville, all of IN (US)" to -- John P. Biondo, Aurora, IN (US) --.

Figure 3A:
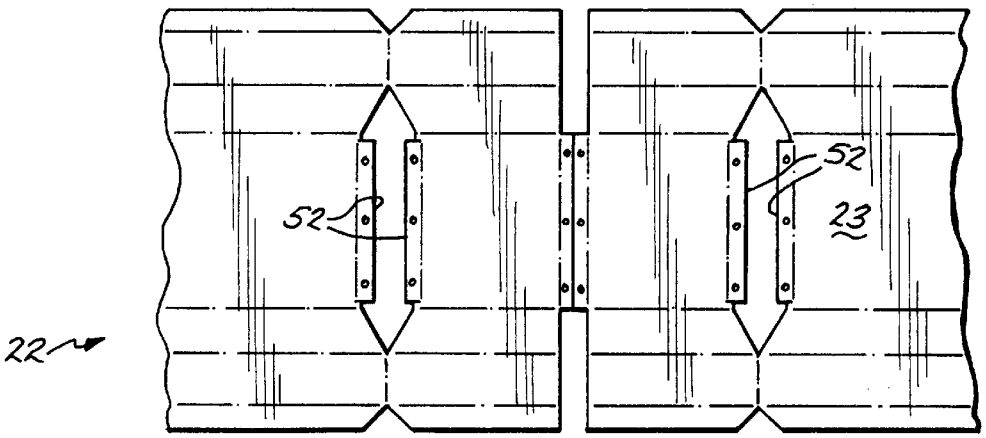

Column 2,
Line 48, change "FIGS. 3 and 3A are plan view of one" to -- FIGS. 3 and 3A are plan views of one --.

Column 4,
Line 24, change "view of an other" to -- view of another --.

Column 5,
Line 30, change "fabricated from a one or more pieces of" to -- fabricated from one or more pieces of --.
Line 53, change "partial or full end 24 and side walls 25" to -- partial or full end walls 24 and side walls 25 --.
Line 67, change "One such a cross-section is shown" to -- One such cross-section is shown --.

Column 6,
Line 9, change "to form a corner. the tabs 52" to -- to form a corner, the tabs 52 --.
Line 28, change "respective bases portions 28 and" to -- respective base portions 28 and --.

Column 7,
Line 4, change "respective an upper rim portion 30, a" to -- respectively an upper rim portion 30, a --.
Line 62, change "If the tabs 72, 74 are" to -- if the tabs 72, 74 are --.

Column 14,
Line 42, change "the lip 246 may molded" to -- the lip 246 may be molded --.

UNITED STATES PATENT AND TRADEMARK OFFICE

CERTIFICATE OF CORRECTION

PATENT NO. : 6,301,758 B1
DATED : October 16, 2001
INVENTOR(S) : John P. Biondo

It is certified that error appears in the above-identified patent and that said Letters Patent is hereby corrected as shown below:

Column 15,
Line 67, change "the bottom of 26 of the shell 22" to -- the bottom 26 of the shell 22 --.

Column 17,
Line 22, change "no intention to restrict nor in any way" to -- no intention to restrict or in any way --.
Line 28, change "constructions, the more than four walls 23" to -- constructions, more than four walls 23 --.

Column 18,
Line 22, change "mechanism and an the liner; and" to -- mechanism and the liner; and --.

Signed and Sealed this

Fourteenth Day of May, 2002

*Attest:*

*Attesting Officer*

JAMES E. ROGAN
*Director of the United States Patent and Trademark Office*